US009403364B2

(12) United States Patent
Ichizono

(10) Patent No.: US 9,403,364 B2
(45) Date of Patent: Aug. 2, 2016

(54) LIQUID DISCHARGE HEAD, AND RECORDING DEVICE PROVIDED WITH SAME

(71) Applicant: KYOCERA Corporation, Kyoto-shi, Kyoto (JP)

(72) Inventor: Takaaki Ichizono, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/652,249

(22) PCT Filed: Dec. 25, 2013

(86) PCT No.: PCT/JP2013/084698

§ 371 (c)(1),
(2) Date: Jun. 15, 2015

(87) PCT Pub. No.: WO2014/104109

PCT Pub. Date: Jul. 3, 2014

(65) Prior Publication Data

US 2015/0321474 A1 Nov. 12, 2015

(30) Foreign Application Priority Data

Dec. 26, 2012 (JP) ..... 2012-283049

(51) Int. Cl.

| | |
|---|---|
| ***B41J 2/015*** | (2006.01) |
| ***B41J 2/14*** | (2006.01) |
| ***B41J 2/055*** | (2006.01) |
| ***B41J 2/155*** | (2006.01) |

(52) U.S. Cl.

CPC ..... *B41J 2/1433* (2013.01); *B41J 2/055* (2013.01); *B41J 2/14233* (2013.01); *B41J 2/155* (2013.01); *B41J 2002/14362* (2013.01); *B41J 2002/14387* (2013.01); *B41J 2002/14491* (2013.01)

(58) Field of Classification Search

None

See application file for complete search history.

(56) References Cited

U.S. PATENT DOCUMENTS

2005/0083379 A1 4/2005 Chikamoto
2006/0092196 A1* 5/2006 Iwao et al. ..... 347/5

(Continued)

FOREIGN PATENT DOCUMENTS

EP 1506867 A1 2/2006
JP 2005-059438 A 3/2005

(Continued)

OTHER PUBLICATIONS

International Search Report, PCT/JP2013/084698, Jan. 28, 2014, 1 pg.

*Primary Examiner* — Erica Lin
(74) *Attorney, Agent, or Firm* — Volpe and Koenig, P.C.

(57) ABSTRACT

The present invention aims to provide a liquid discharge head capable of reducing the possibility that ink intrudes into the interior thereof. The liquid discharge head includes a head body which has a plurality of discharge holes, a plurality of pressurizing chambers communicating with the discharge holes, and piezoelectric bodies disposed correspondingly to the pressurizing chambers, a flexible wiring board electrically connected to the piezoelectric bodies, a first member having a hole disposed on the head body, and a second member disposed on the first member. A part of the second member is disposed so as to cover the hole in a plan view. The flexible wiring board is passed through the hole and is led out from between the first member and the second member.

20 Claims, 14 Drawing Sheets

(56) References Cited

U.S. PATENT DOCUMENTS

2006/0164476 A1* 7/2006 Watanabe et al. ..... 347/85
2007/0263053 A1 11/2007 Imai

FOREIGN PATENT DOCUMENTS

JP 2007-301880 A 11/2007
JP 2007-326323 A 12/2007

* cited by examiner

LIQUID DISCHARGE HEAD, AND RECORDING DEVICE PROVIDED WITH SAME

TECHNICAL FIELD

The present invention relates to a liquid discharge head and a recording device including the liquid discharge head.

BACKGROUND ART

Recently, printing apparatuses using inkjet recording method, such as inkjet printers or inkjet plotters, have been widely used in not only printers for general consumers but also industrial purposes, such as formation of electronic circuits, production of color filters for liquid crystal displays, and production of organic EL displays.

These inkjet type printing apparatuses include a liquid discharge head, a transport section that transports a recording medium to the liquid discharge head, and a control section that controls the liquid discharge head. Printing is carried out by driving the liquid discharge head.

The liquid discharge head includes a plurality of discharge holes, a plurality of pressurizing chambers respectively communicating with the discharge holes, a head body having pressurizing parts disposed correspondingly to the pressurizing chambers, a flexible wiring board electrically connected to the pressurizing parts, a first member disposed on the head body, and a second member disposed on the first member. The first member has a hole that permits insertion of the flexible wiring board (see, for example, Patent Document 1).

PRIOR ART DOCUMENT

Patent Document

Patent Document 1: Japanese Unexamined Patent Publication No. 2007-301880

SUMMARY OF THE INVENTION

Problems to be Solved by the Invention

However, there is a possibility that, for example, mist-state ink intrudes from the hole disposed on the first member into the head body disposed inside the liquid discharge head. The intruded ink may result in malfunction in the liquid discharge head.

Means for Solving the Problems

A liquid discharge head of the present invention includes (i) a head body which has a plurality of discharge holes, a plurality of pressurizing chambers communicating with the discharge holes, and pressurizing parts disposed correspondingly to the pressurizing chambers, (ii) a flexible wiring board electrically connected to the pressurizing parts, (iii) a first member that is disposed on the head body and has a hole, and (iv) a second member disposed on the first member. A part of the second member is disposed so as to cover the hole in a plan view. The flexible wiring board is passed through the hole and is led out from between the first member and the second member.

A recording device of the present invention includes the liquid discharge head, a transport section configured to transport a recording medium with respect to the liquid discharge head, and a control section configured to control the liquid discharge head.

Effect of the Present Invention

The present invention is capable of reducing the possibility that ink intrudes into the head body.

EMBODIMENTS FOR CARRYING OUT THE INVENTION

First Embodiment

Figure 1:
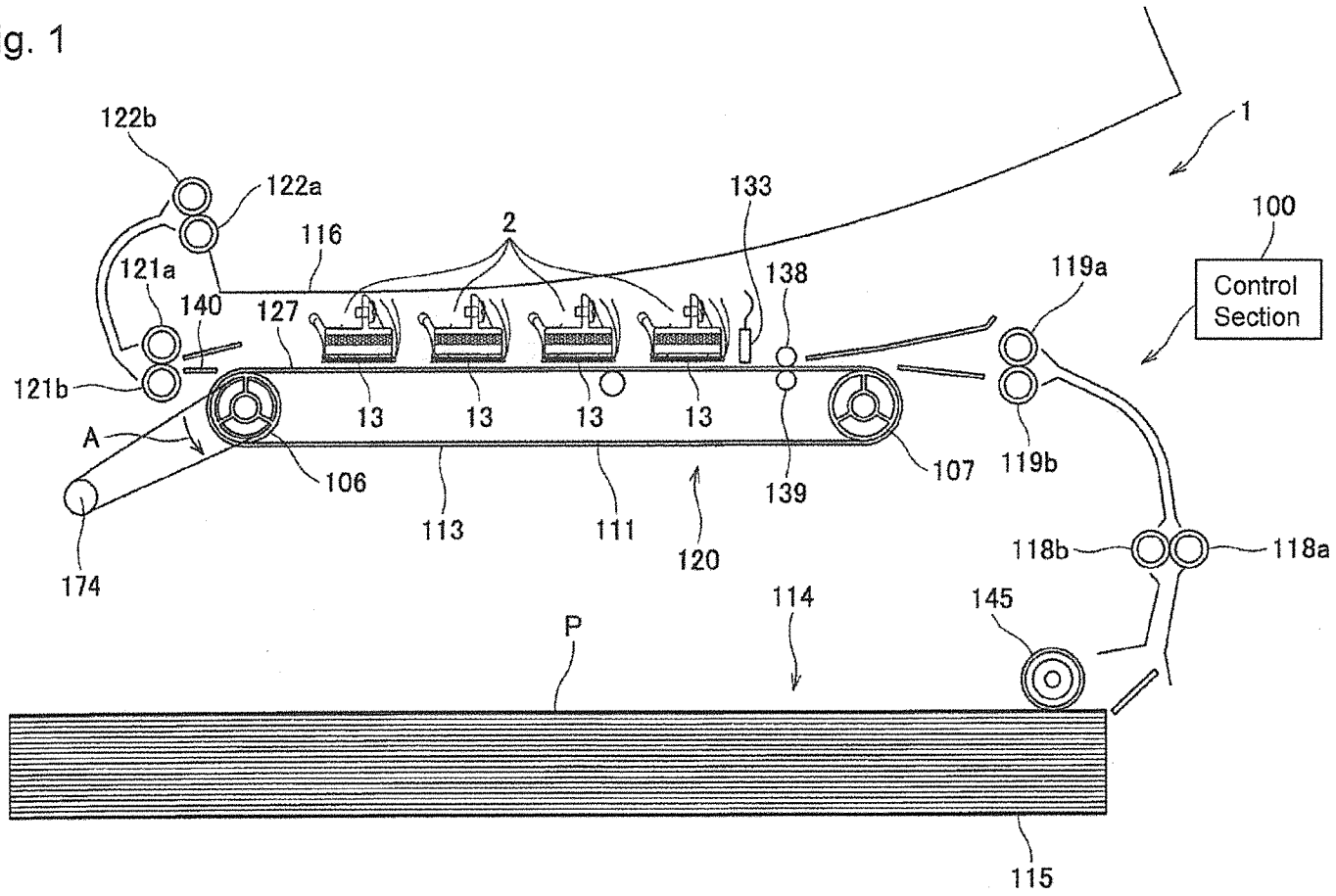
FIG. 1 is a schematic configuration view of a printer that is a recording device including a liquid discharge head according to a first embodiment.

FIG. 1 is a schematic configuration view of a color inkjet printer that is a recording device including a liquid discharge head according to an embodiment of the present invention. The color inkjet printer 1 (hereinafter referred to as the printer 1) has four liquid discharge heads 2. These liquid discharge heads 2 are disposed along a transport direction of a printing paper P and are secured to the printer 1. The liquid discharge heads 2 have such a shape that is elongated in a direction from the near side to the rear side in FIG. 1. The elongated direction is generally referred to as one direction.

The printer 1 includes a paper feed unit 114, a transport unit 120, and a paper receiving part 116, which are sequentially disposed along a transport path of the printing paper P. The printer 1 also includes a control section 100 to control operations in individual components of the printer 1, such as the liquid discharge heads 2 or the paper feed unit 114.

The paper feed unit 114 includes a paper storage case 115 and a paper feed roller 145. The paper storage case 115 is capable of storing a plurality of printing papers P. The paper feed roller 145 is capable of feeding out one by one the printing paper P located uppermost among the printing papers P stackedly stored in the paper storage case 115.

Two pairs of feed rollers 118*a* and 118*b*, and 119*a* and 119*b* are disposed along the transport path for the printing papers P between the paper feed unit 114 and the transport unit 120. The printing paper P fed out of the paper feed unit 114 is guided by these feed rollers 118*a* and 118*b* so as to be fed to the transport unit 120.

The transport unit 120 includes a transport belt 111 and two belt rollers 106 and 107. The transport belt 111 is entrained around the belt rollers 106 and 107. The transport belt 111 is adjusted to such a length as to be stretched under a predetermined tension when being entrained around the two belt rollers 106 and 107. This ensures that the transport belt 111 is stretched without looseness along two planes parallel to each other which respectively include common tangents of the two belt rollers 106 and 107. One of these two planes which is close to the liquid discharge head 2 is a transport surface 127 along which the printing paper P is transported.

A transport motor 174 is connected to the belt roller 106 as shown in FIG. 1. The transport motor 174 is to rotate the belt roller 106 in an arrowed direction A. The belt roller 107 is rotatable interlockingly with the transport belt 111. Accordingly, the transport belt 111 is moved along the arrowed direction A by driving the transport motor 174 so as to rotate the belt roller 106.

A nip roller 138 and a nip receiving roller 139 are disposed in the vicinity of the belt roller 107 so as to hold the transport belt 111 therebetween. The nip roller 138 is energized downward by an unshown spring. The nip receiving roller 139 below the nip roller 138 receives the downwardly energized nip roller 138 with the transport belt 111 interposed therebetween. These two nip rollers are disposed rotatably so as to rotate interlockingly with the transport belt 111.

The printing paper P fed from the paper feed unit 114 to the transport unit 120 is nipped between the nip roller 138 and the transport belt 111. This ensures that the printing paper P is pressed against the transport surface 127 of the transport belt 111 so as to be adhered onto the transport surface 127. According to the rotation of the transport belt 111, the printing paper P is then transported in a direction in which the liquid discharge heads 2 are disposed. Alternatively, an outer peripheral surface 113 of the transport belt 111 may be subjected to processing with adhesive silicone rubber. This allows the printing paper P to be surely adhered to the transport surface 127.

The four liquid discharge heads 2 are disposed closely adjacent one another along the transport direction. Each of the liquid discharge heads 2 has a head body 13 at a lower end thereof. A lower surface of the head body 13 serves as a discharge hole surface 4*a* (refer to FIG. 10) having thereon a large number of discharge holes 8 (refer to FIG. 10) through which the liquid is discharged.

Liquids (inks) having the same color are to be discharged from the discharge holes 8 disposed on the single liquid discharge head 2. The discharge holes 8 of the liquid discharge heads 2 are equally spaced in one direction so as to ensure printing in the one direction without leaving any blank space. The colors of liquids to be discharged from the liquid discharge heads 2 are respectively, for example, magenta (M), yellow (Y), cyan (C), and black (K). These liquid discharge heads 2 are disposed between the discharge hole surface 4*a* on the lower surface of the liquid discharge head body 13 and the transport surface 127 of the transport belt 111 with a slight clearance left therebetween.

The printing paper P that is already transported by the transport belt 111 is then passed through a clearance between the liquid discharged head 2 and the transport belt 111. On that occasion, liquid drops are to be discharged from the head body 13 constituting the liquid discharge head 2 toward an upper surface of the printing paper P. Consequently, a color image on the basis of image data stored by the control section 100 is formed on the upper surface of the printing paper P.

A peel-off plate 140 and two pairs of feed rollers 121*a* and 121*b*, and 122*a* and 122*b* are disposed between the transport unit 120 and the paper receiving part 116. The printing paper P having the color image printed thereon is then transported to the peel-off plate 140 by the transport belt 111. On that occasion, the printing paper P is peeled off from the transport surface 127 by a right end of the peel-off plate 140. The printing paper P is then fed to the paper receiving part 116 by the feed rollers 121*a*, 121*b*, 122*a*, and 122*b*. Thus, the printing papers P after being subjected to the printing are sequentially fed to the paper receiving part 116 so as to be stacked on the paper receiving part 116.

A paper surface sensor 133 is disposed between the nip roller 138 and the liquid discharge head 2 located on the most upstream side in the transport direction of the printing paper P. The paper surface sensor 133 is formed of a light-emitting device and a light-receiving device, and is capable of detecting a front end position of the printing paper P on the transport path. A detection result obtained by the paper surface sensor 133 is transmitted to the control section 100. The control section 100 is capable of controlling, for example, the liquid discharge heads 2 and the transport motor 174 or the like so as to establish synchronization between the transport of the printing paper P and the printing of the image according to the detection result transmitted from the paper surface sensor 133.

Figure 2:
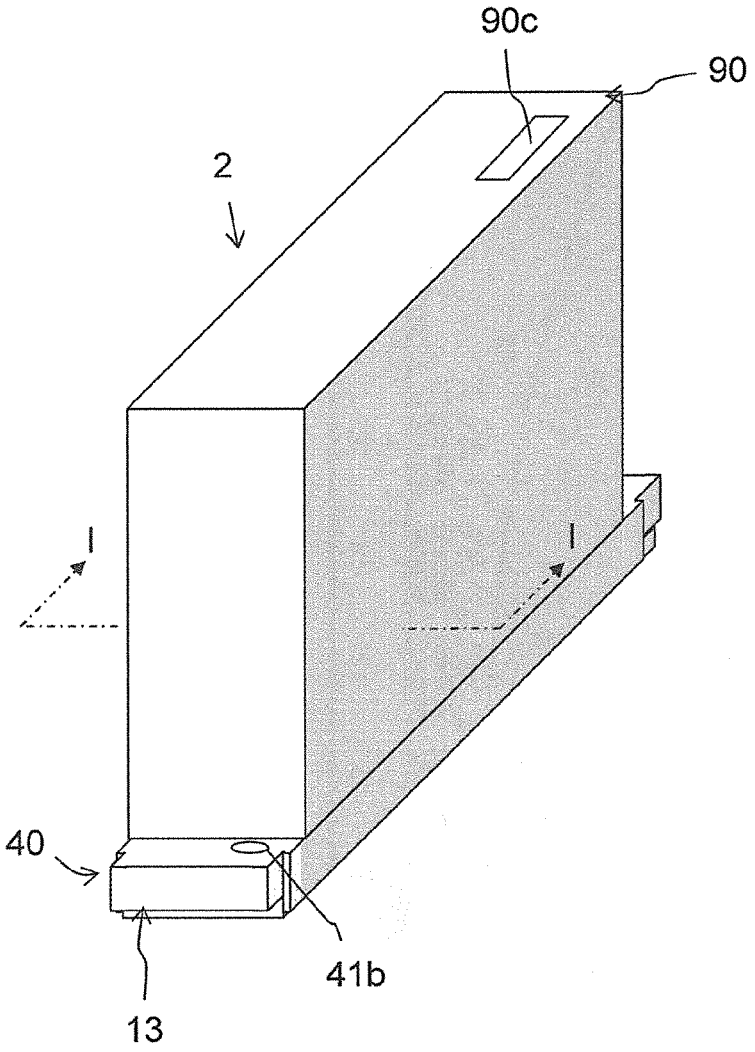
FIG. 2 is a perspective view of the liquid discharge head shown in FIG. 1.
Figure 3:
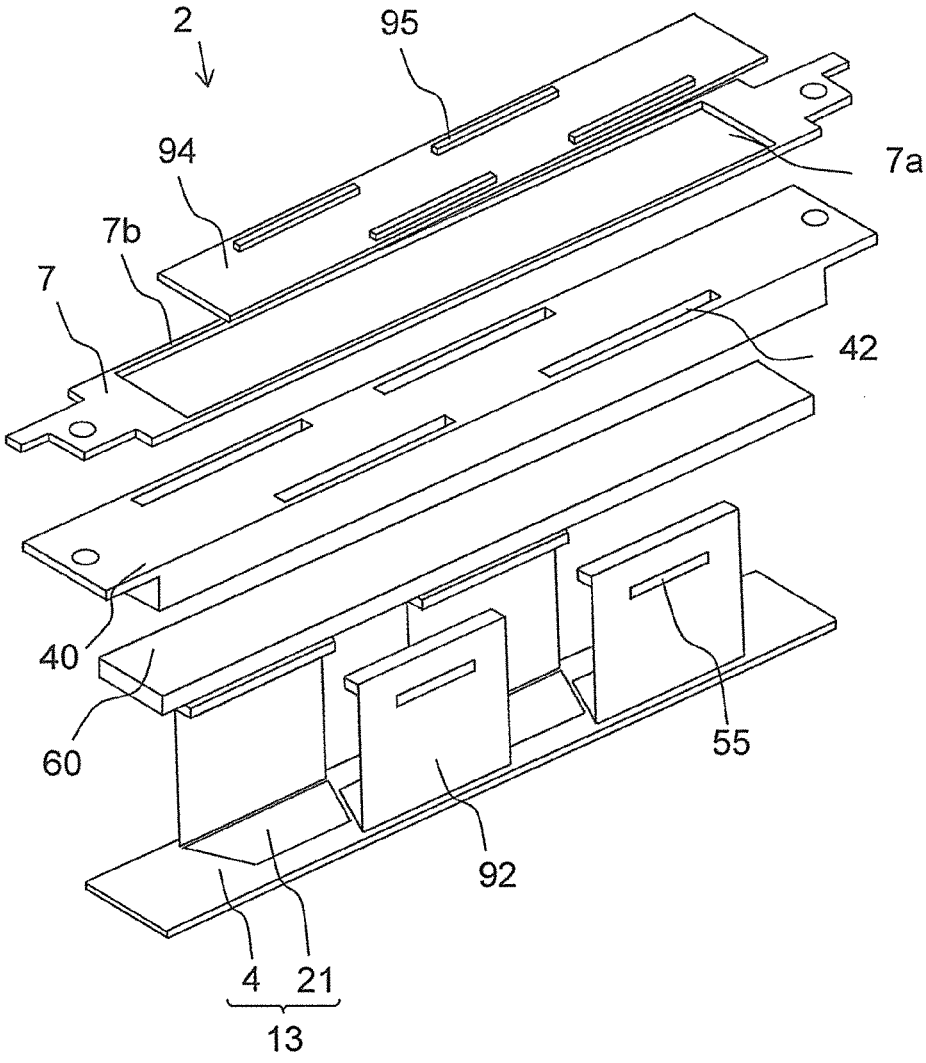
FIG. 3 is an exploded plan view of the liquid discharge head shown in FIG. 1.

The liquid discharge heads 2 are described below. FIG. 2 is a perspective view of the liquid discharge head 2. The liquid discharge head 2 includes the head body 13, a reservoir flow channel member 40 disposed on the head body 13, and a housing 90. The housing 90 is formed of metal, and has at a part thereof a hole 90*c* that permits passage of a signal cable (not shown) through which a drive signal is transmitted.

As shown in FIG. 2, the hole 90*c* is formed at a part of an upper surface of the housing 90, and the hole 90*c* permits passage of the signal cable which permits transmission of the drive signal and is connected to the control section 100 (refer to FIG. 1). The hole 90*c* is covered with a resin lid body. The reservoir flow channel member 40 has a liquid inlet hole 41*b* at an end thereof, and liquid is to be supplied to the reservoir flow channel member 40 through the liquid inlet hole 41*b*. The reservoir flow channel member 40 is an embodiment related to the first member of the present invention. The first member is described below by illustrating the reservoir flow channel member 40.

As shown in FIGS. 3 to 6, the liquid discharge head 2 includes the head body 13 that is elongated in one direction, flexible wiring boards 92, a branch flow channel member 60, the reservoir flow channel member 40, a positioning member 7, and a substrate 94. The branch flow channel member 60 is disposed on the head body 13. The reservoir flow channel member 40 is disposed on the branch flow channel member 60 so as to cover the head body 13 and the branch flow channel member 60. That is, the reservoir flow channel member 40 is disposed on the head body 13. The positioning member 7 is disposed on the reservoir flow channel member 40. The substrate 94 is disposed on the reservoir flow channel member 40 so as to be located in an opening 7*a* of the positioning member 7. The reservoir flow channel member 40 has four holes 42, and the flexible wiring boards 92 connected to the head body 13 are respectively inserted into these holes 42. The positioning member 7 is an embodiment related to the second member of the present invention. The second member is described below by illustrating the positioning member 7.

The head body 13 includes the flow channel member 4 and a piezoelectric actuator substrate 21. The flexible wiring boards 92 are connected to the piezoelectric actuator substrate 21.

The branch flow channel member 60 is disposed on the head body 13 and has the function of supplying the liquid to the head body 13. The branch flow channel member 60 includes a branch flow channel 61 (refer to FIG. 6), and a liquid inlet hole 61*b* that is one end of the branch flow channel 61 is connected to a liquid outlet hole 41*a* of a reservoir flow channel 41 of the reservoir flow channel member 40 (refer to FIG. 6), and is branched halfway and connected to an opening 5*b* of a manifold in the flow channel member 4 (refer to FIG. 7) through a plurality of locations.

The reservoir flow channel member 40 has the function of protecting the head body 13 and the branched flow channel member 60. The reservoir flow channel member 40 has therein a reservoir flow channel 41 and has the function of supplying the liquid supplied from the exterior to the branch flow channel member 60.

Figure 5A:
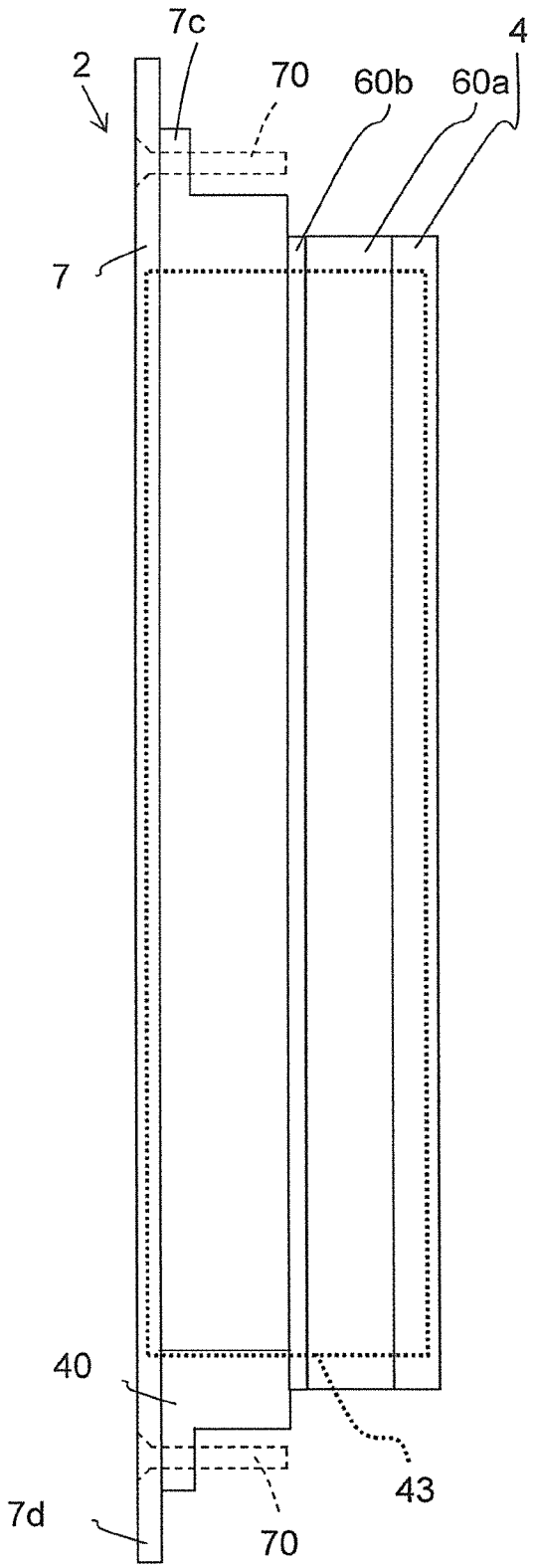
FIG. 5(*a*) is a side view of the liquid discharge head shown in FIG. 1, and FIG. 5(*b*) is a plan view thereof.
Figure 5B:
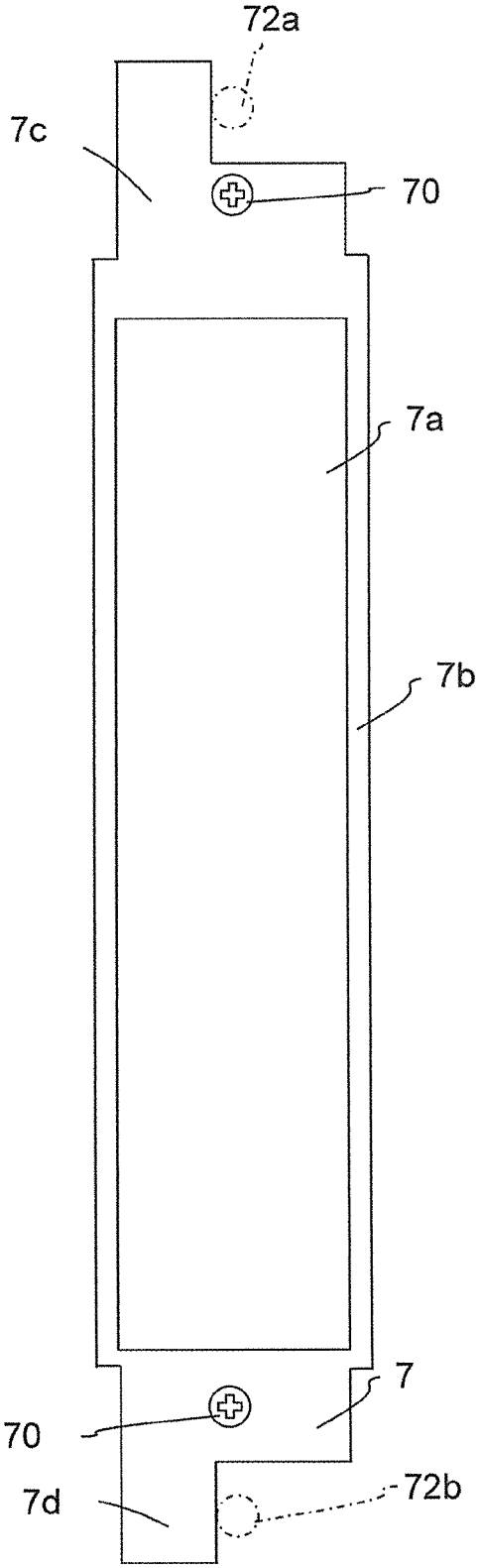

As shown in FIG. 5, the positioning member 7 is elongated in one direction and includes positioning portions 7*c* and 7*d* disposed on both ends in the one direction, a coupling portion 7*b* to connect the positioning portions 7*c* and 7*d* to each other, and an opening 7*a* formed by the positioning portions 7*c* and 7*d* and the coupling portion 7*b*. The coupling portion 7*b* is disposed on the holes 42 of the reservoir flow channel member 40. Therefore, the holes 42 of the reservoir flow channel member 40 are covered with the positioning member 7 in a plan view.

The positioning member 7 is used for positioning upon attachment to the printer 1. The positioning portion 7*c* and 7*d* are respectively disposed at both ends in the one direction of the liquid discharge head 2. The positioning portions 7*c* and 7*d* are configured to be integrated with each other by the coupling portion 7*b*. Thus, the positioning portions 7*c* and 7*d* are integrated with each other. This configuration facilitates assembly because the position of the positioning portion 7*d* is settled at a predetermined position by positioning of the positioning portion 7*c*, and vice versa.

A large distance between the positioning portions 7*c* and 7*d* is ensured by disposing the positioning portion 7*c* and 7*d* at the both ends in the one direction. Therefore, even if deformation occurs in the positioning member 7 when fixing the positioning portion 7*c*, the influence exerted on the positioning portion 7*d* can be reduced to improve positioning accuracy of the attachment of the positioning member 7.

The flexible wiring boards 92 are passed through the outside of the branch flow channel member 60 and are guided into the reservoir flow channel member 40. The flexible wiring boards 92 are then led out upward through the holes 42 of the reservoir flow channel member 40. The flexible wiring boards 92 led out of the holes 42 are in contact with the positioning member 7 and the reservoir flow channel member 40. The flexible wiring boards 92 are pressed by the positioning member 7 disposed above and are led out upward from the opening 7*a* of the positioning member 7. Each of the flexible wiring boards 92 has a driver IC 55 mounted on a surface thereof, and is electrically connected to a connector 95 of the substrate 94 disposed above the positioning member 7.

In the liquid discharge head 2, a part of the positioning member 7 is disposed on the holes 42 formed on the reservoir flow channel member 40, and the flexible wiring boards 92 are respectively inserted into the holes 42 and are led out above the positioning member 7. Consequently, the positioning member 7 is disposed so as to cover the holes 42. Therefore, even when the mist-state ink flows in above the holes 42 when the liquid discharge heads 2 are driven to print an image, the positioning member 7 is capable of reducing the intrusion of mist-state ink into the holes 42. This makes it possible to reduce the possibility that the mist-state ink intrudes into the head body 13.

The flexible wiring boards 92 are led out above the holes 42 in a state of being contacted with the positioning member 7. Therefore, even when the mist-state ink attaches to the flexible wiring boards 92 and the ink attached to the flexible wiring boards 92 flows downward along the flexible wiring boards 92, the intrusion of the ink is preventable by the positioning member 7 in contact with the flexible wiring boards 92.

The flexible wiring boards 92 are also in contact with the positioning member 7 and the reservoir flow channel member 40, and are held by the positioning member 7 and the reservoir flow channel member 40. Therefore, even when the ink attached to the flexible wiring boards 92 flows downward along the flexible wiring boards 92, the intrusion of the ink is preventable by the positioning member 7 and the reservoir flow channel member 40 in contact with the flexible wiring boards 92.

After the flexible wiring boards 92 are respectively inserted into the holes 42, the positioning member 7 presses the flexible wiring boards 92, and the flexible wiring boards 92 function to seal the holes 42, thereby making it possible to improve sealability of the liquid discharge head 2.

The flexible wiring boards 92 are led out upward from the inside of the opening 7*a* of the positioning member 7 and are pressed by the positioning member 7. Therefore, the flexible wiring boards 92 are bendable toward the inside of the opening 7*a*, thereby reducing the possibility that the driver IC 55 mounted on each of the flexible wiring boards 92 is peeled off upon contact with other member.

The flexible wiring boards 92 are inserted upward from the inside of the opening 7*a* of the positioning member 7. Consequently, the flexible wiring boards 92 are passed through the interior of the coupling portion 7*b* of the positioning member 7. This makes it possible to reduce the possibility that the flexible wiring boards 92 are brought into contact with other member, thereby reducing the possibility that the flexible wiring boards 92 are damaged. The present invention operates effectively, particularly in the liquid discharge heads 2 without the housing 90.

Figure 4:
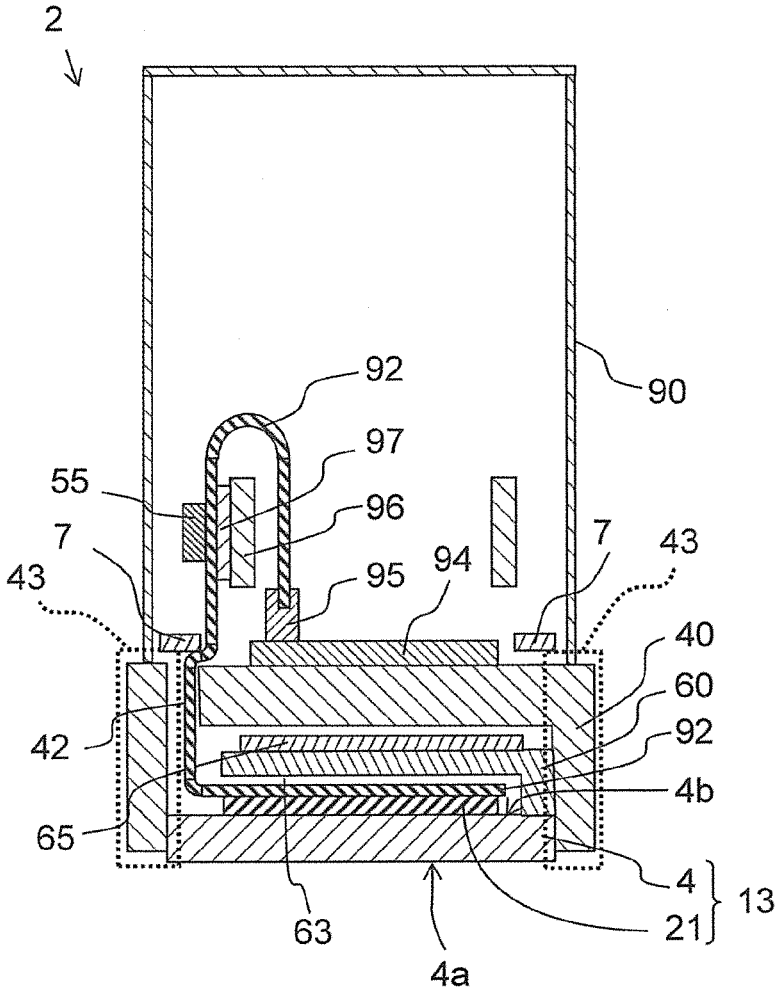
FIG. 4 is a cross sectional view taken along line I-I shown in FIG. 2.

FIG. 4 illustrates, by way of example, the case where the flexible wiring boards 92 are upwardly passed through the holes 42 from the inside of the opening 7*a* of the positioning member 7. For example, the flexible wiring boards 92 may be upwardly passed through the holes 42 from the outside of the opening 7*a* of the positioning member 7. The positioning member 7 may have a flat plate shape not having the opening 7*a*. Also in these cases, a part of the positioning member 7 is located above the holes 42, and hence the positioning member 7 covers the holes 42 and the flexible wiring boards 92, thereby reducing the possibility of the intrusion of the ink into the liquid discharge heads 2.

Figure 6:
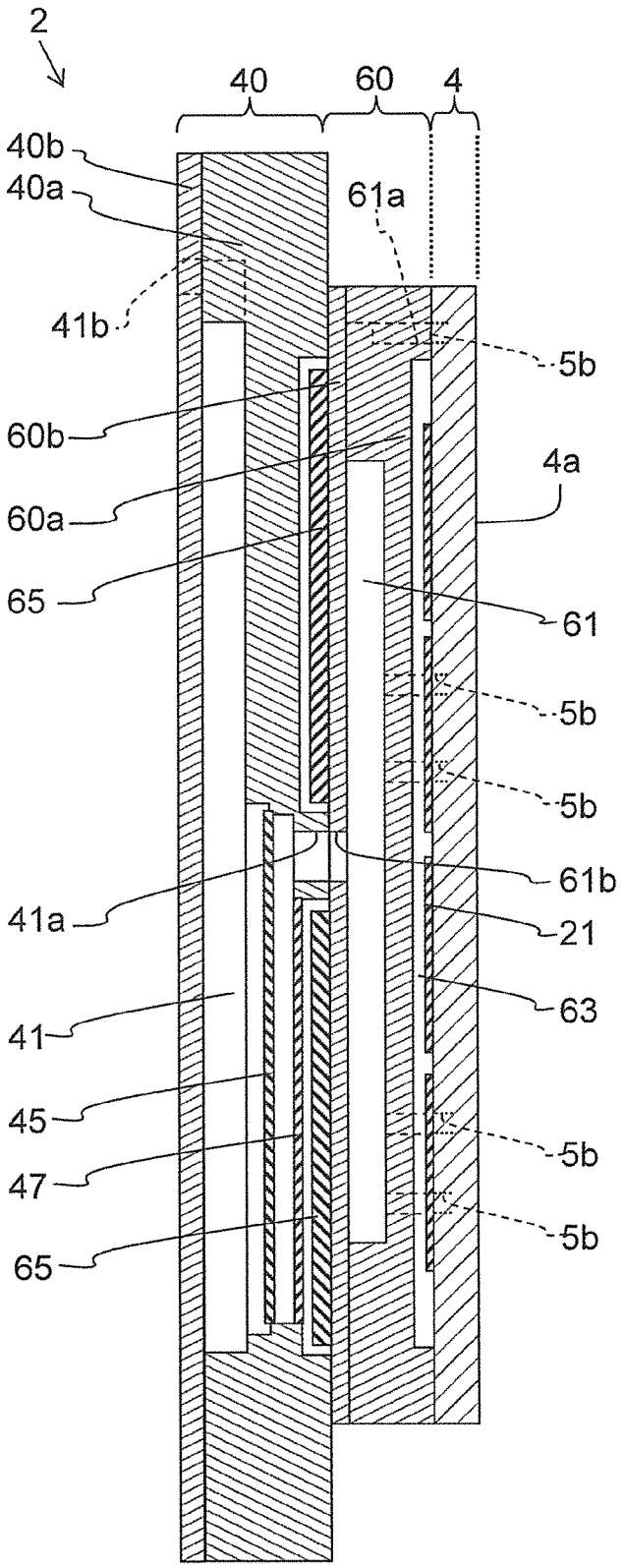
FIG. 6 is a cross sectional view of the liquid discharge head shown in FIG. 1.

As shown in FIG. 4, the reservoir flow channel member 40 includes a side surface protection plate 43, and the side surface protection plate 43 is in contact with a side surface along a long side of the flow channel member 4. Consequently, a recess 63 accommodated on the piezoelectric actuator substrate 21 forms a closed space, and only openings of the holes 42 located above are communicated with the exterior. In FIG. 6, the side surface protection plate 43 is omitted.

The side surface protection plate 43 and the side surface along the long side of the flow channel member 4 may be bonded together. Alternatively, the side surface protection plate 43 may be formed of a resin so as to keep holding down with elastic deformation thereof. For example, chemical that flows and has high viscosity may be interposed between the side surface protection plate 43 and the flow channel member 4 in order to prevent the intrusion of liquid, such as ink. When the branch flow channel member 60 and the reservoir flow channel member 40 are connected to each other only at a central part in one direction, both the suppression of the intrusion of the liquid and the relaxation of stress due to a difference in coefficient of thermal expansion are attainable by keeping holding down with the elastic deformation or by interposing the chemical with the high viscosity. The side surface protection plate 43 is not necessarily required.

The positioning member 7 to determine the position of the head body 13, a frame 96 having a heat insulation elastic member 97 attached thereto, and the substrate 94 having the connector 95 mounted thereon are secured to the reservoir flow channel member 40. Although the frame 96 is not connected in the cross sectional view of FIG. 4, the frame 96 is secured to a portion other than the section in FIG. 4.

A drive signal transmitted from the control section 100 (refer to FIG. 1) via a signal cable (not shown) to the substrate 94 is to be transmitted to the flexible wiring boards 92 via the connector 95. The driver IC 55 mounted on each of the flexible wiring boards 92 processes the driver signal, and the processed driver signal is to drive, through the flexible wiring boards 92, a displacement element 50 that is a liquid discharge element of the piezoelectric actuator substrate 21 so as to pressurize the liquid in the flow channel member 4, thereby discharging liquid drops. The substrate 94 may be configured to, for example, branch a discharge signal into the driver ICs 55, or may perform rectification of the discharge signal. Alternatively, the signal cable from the control section 100 may be directly connected to the flexible wiring boards 92 without disposing the substrate 94.

The flexible wiring boards 92 are flexible belt-shaped ones and have metal wiring therein. A part of the wiring is exposed to a surface of each of the flexible wiring boards 92, and the connector 95, the driver IC 55, and the piezoelectric actuator substrate 21 are electrically connected to one another by the exposed wiring. Examples of the flexible wiring boards 92 include a flexible flat cable and flexible printed circuit (FPC).

Each of the driver ICs 55 generates heat during the drive signal processing as described above. The driver IC 55 is pressed against the metal housing 90 by the heat insulation elastic member 97 with the flexible wiring board 92 interposed therebetween. Accordingly, the generated heat is mainly transmitted to the housing 90 and is spread rapidly over the entirety of the housing 90 so as to be released to the outside. The housing 90 is not necessarily required.

The connection of the positioning member 7 and the reservoir flow channel member 40 is described below with reference to FIG. 5. The positioning member 7 and the reservoir flow channel member 40 are screwed by a screw 70 from the side of the positioning member 7, thereby ensuring the connection of the positioning member 7 and the reservoir flow channel member 40. The screw 70 is an embodiment related to a connection member of the present invention. The connection member is described below by illustrating the screw 70.

The liquid discharge head 2 integrated by the screw 70 is positioned by the positioning member 7 and is mounted on the printer (not shown). The positioning is carried out by bringing the positioning portions 7*c* and 7*d* into contact with two positioning pins 72*a* and 72*b* disposed vertically on the printer.

Firstly, the positioning portion 7*c* of the positioning member 7 is brought into contact with the positioning pin 72*a* as shown in FIG. 5(*b*). Subsequently, the positioning portion 7*d* is brought into contact with the positioning pin 72*b* by rotating the liquid discharge head 2 around the positioning pin 72*a* in contact with the positioning portion 7*c*. The positioning thus carried out ensures that the liquid discharge head 2 is mountable on the printer without being inclined in the transport direction.

The case of using the screw 70 as the connection member is described above by way of example only. Adhesive or a double sided tape may be used as the connection member. Alternatively, the positioning member 7 and the reservoir flow channel member 40 may be screwed by the screw 70, or the positioning member 7 and the reservoir flow channel member 40 may be directly secured to each other. Positional accuracy between the positioning member 7 and the discharge holes 8 of the flow channel member 4 connected to the reservoir flow channel member 40 can be enhanced by screwing or directly securing the positioning member 7 and the reservoir flow channel member 40.

The reservoir flow channel member 40 and the branch flow channel member 60 of the head body 13 are described below with reference to FIG. 6. FIG. 6 is a cross sectional view of the flow channel member 4, the branch flow channel member 60, and the reservoir flow channel member 40.

In the head body 13, a branch flow channel member body 60*a* is laminated on the flow channel member 4, and a reservoir flow channel member body 40*a* is laminated on the branch flow channel member body 60*a*. The piezoelectric actuator substrate 21 including pressurizing parts is accommodated in a recess 63 of the branch flow channel member body 60*a*. A branch flow channel 61 is disposed on the branch flow channel member body 60*a*, and a reservoir flow channel 41 is disposed on the reservoir flow channel member body 40*a*.

The reservoir flow channel member 40 is formed of the reservoir flow channel member body 40*a* having thereon a groove servicing as the reservoir flow channel 41, and a plate 40*b* to cover the reservoir flow channel member body 40*a*. The branch flow channel member 60 is formed of the branch flow channel member body 60*a* having thereon a groove servicing as the branch channel 61, and a plate 60*b* to cover the branch flow channel member body 60*a*.

In the reservoir flow channel member 40, the plate 40*b* is disposed oppositely to the reservoir flow channel 41 so as to form the reservoir flow channel 41 on one side of the reservoir flow channel member body 40*a*, and the plate 60*b* is disposed on another side of the reservoir flow channel member body 40*a*. The branch flow channel member body 60*a* is disposed on the opposite side of the plate 60*b*, and the branch flow channel 61 is formed by the groove disposed on the branch flow channel member body 60*a* and the plate 60*b*. The flow channel member 4 having the piezoelectric actuator substrate 21 is disposed on the opposite side of the branch flow channel member body 60*a*.

The liquid inlet hole 41*b* of the reservoir flow channel 41 is connected to an exterior liquid tank (not shown), the liquid loaded from the liquid inlet hole 41*b* of the reservoir flow channel 41 passes through the liquid outlet hole 41*a* of the reservoir flow channel 41 and enters a reservoir flow channel 61 from a liquid inlet hole 61*b* of the branch flow channel 61. Then, the liquid flows into each of a plurality of flow channels branched halfway, passes through the liquid outlet hole 61*a* of the branch flow channel 61, and flows from openings 5*b* of the manifolds into the manifold 5 that is a common flow channel.

The liquid inlet holes 41*b* of the reservoir flow channel 41 are disposed at two locations. One of the liquid inlet holes 41*b* is basically only used for releasing air or liquid when liquid is firstly loaded, and the liquid is supplied from either one and the other is closed during printing. This ensures that the liquid in the reservoir flow channel 41 flows mainly from the liquid inlet hole 41*b* of the reservoir flow channel 41 that permits loading of the liquid to the liquid outlet hole 41*a* of the centrally located reservoir flow channel 41, and the liquid seldom flows on the closed liquid inlet hole side. When a temperature of the liquid loaded from the outside is different from a temperature of the head body 13, the temperature of the head body 13 is changed, and the temperature on the liquid inlet side is changed greatly due to imbalance of the liquid motion as described above.

A part of an inner wall of the reservoir flow channel 41 is a damper 47 formed of an elastically deformable material. A surface of the damper 47 opposite to the reservoir flow channel 41 is deformable in a facing direction. Therefore, a volume of the reservoir flow channel 41 is changeable by elastic deformation of the damper 47. This makes it possible to stably supply the liquid when, for example, the amount of discharge of the liquid is rapidly increased. The damper 47 is configured to face a space formed in the reservoir flow channel member body 40*a* in order to accommodate a heater 65 therein. This improves space efficiency and downsizes the liquid discharge head 2. Additionally, heat conduction can be further suppressed by loading the liquid from a side on which the damper 47 is disposed.

A filter 45 is preferably disposed in the reservoir flow channel 41 in order to prevent foreign matter contained in the liquid from entering the branch flow channel member 4, thereby suppressing non-discharge caused by clogging of the foreign matter.

The reservoir flow channel member body 40*a* and the branch flow channel member body 60*a* are formed of a metal or alloy member. Alternatively, both are producible with a resin. Even when the reservoir flow channel 41 and the branch flow channel 61 have a complicated shape, an inexpensive production thereof is attainable by producing both with the resin. The plates 40*b* and 60*a* are also formed of a metal or alloy member or a resin.

Figure 7:
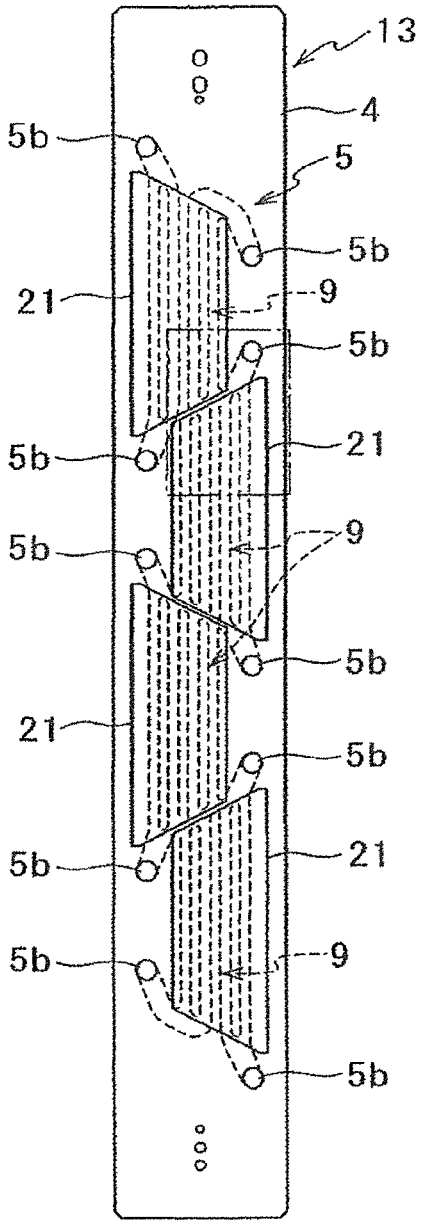
FIG. 7 is a plan view of a flow channel member and a piezoelectric actuator which constitute the liquid discharge head shown in FIG. 1.
Figure 8:
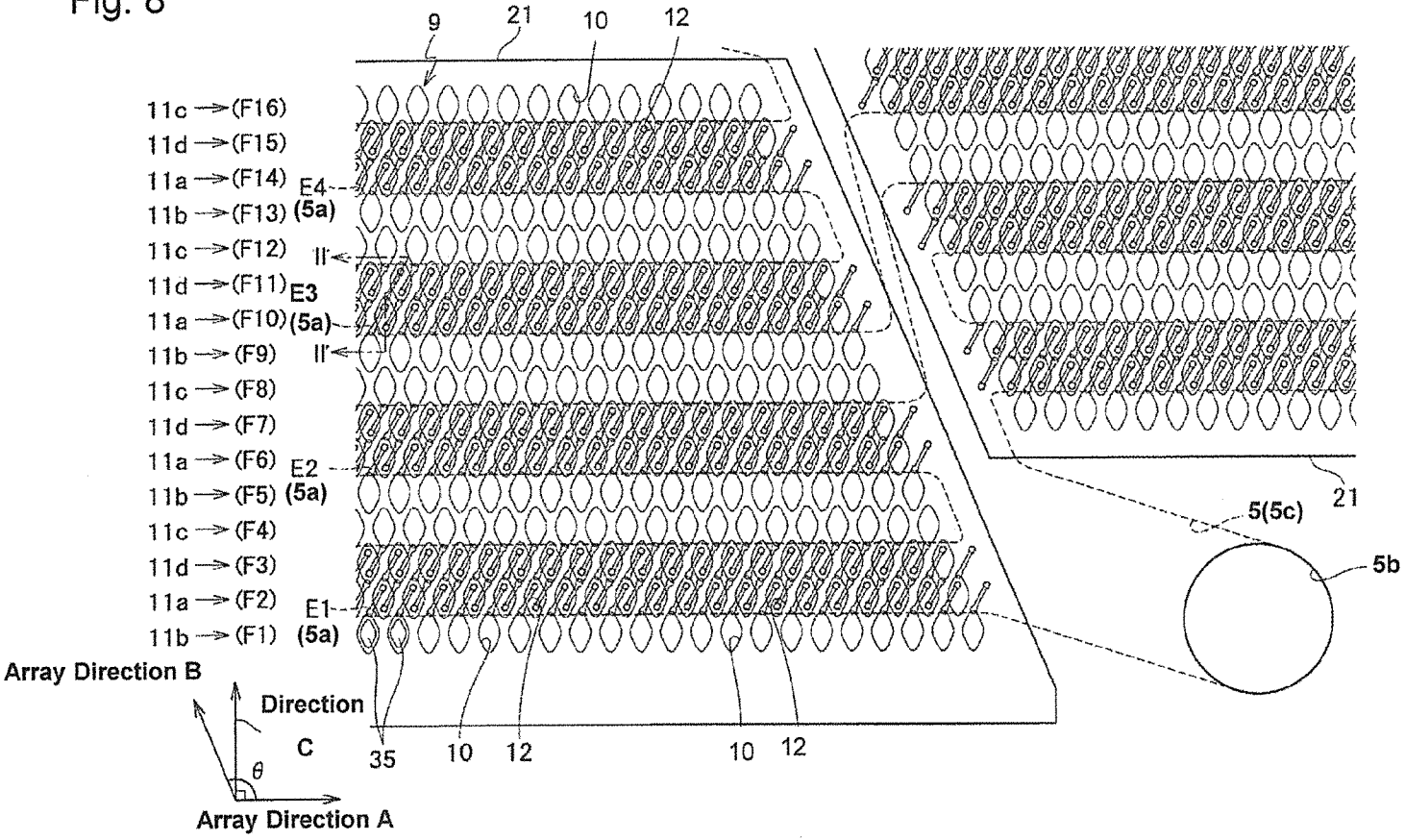
FIG. 8 is an enlarged view of a region surrounded by a chain line in FIG. 7.
Figure 9:
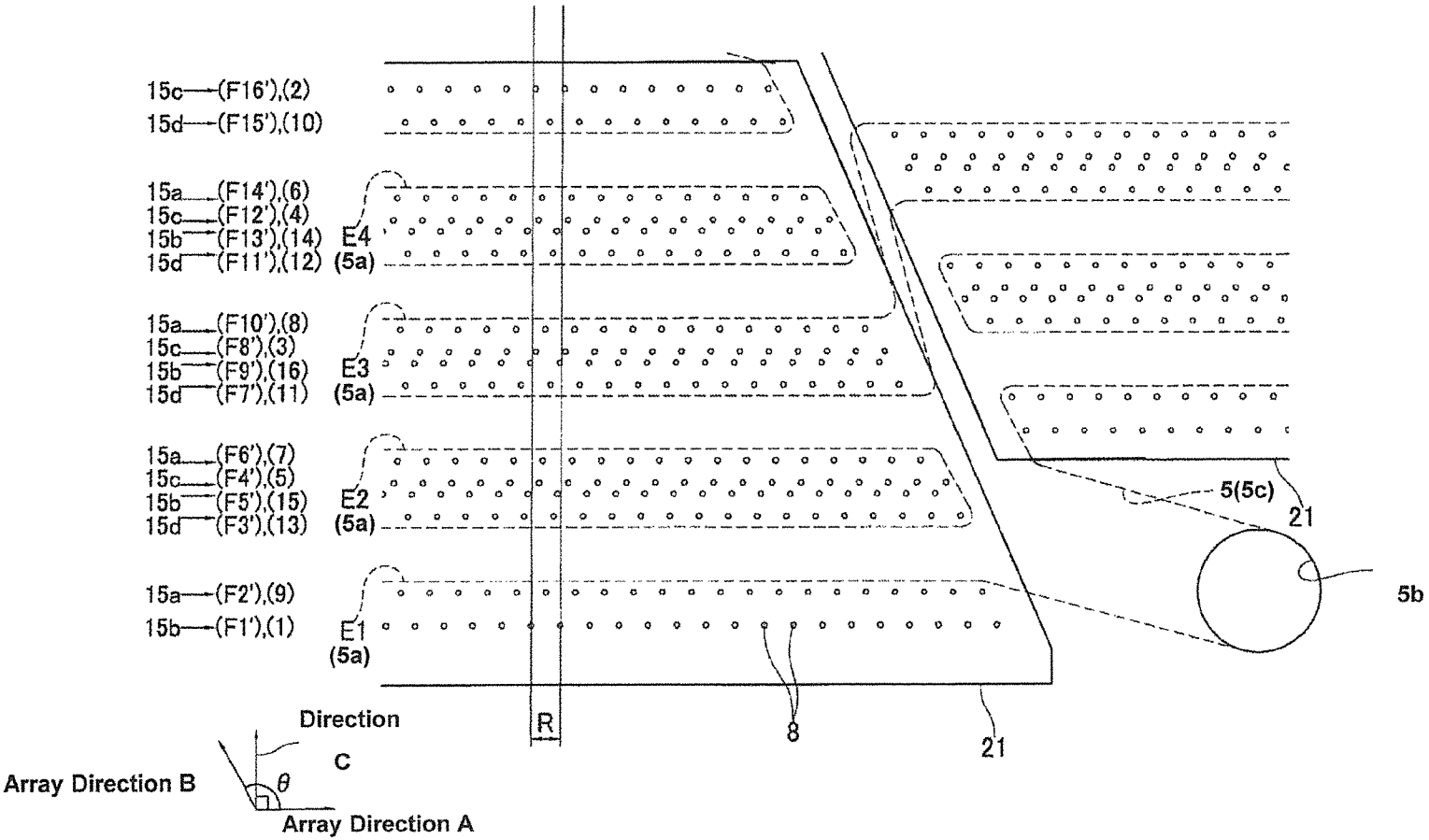
FIG. 9 is an enlarged view of the region surrounded by the chain line in FIG. 7, from which some of flow channels are omitted for the sake of description.
Figure 10:
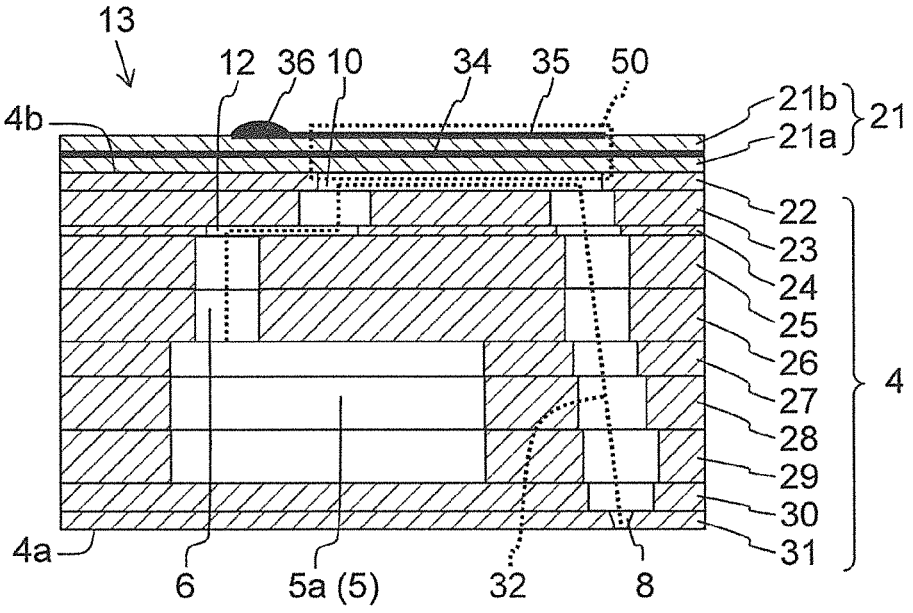
FIG. 10 is a longitudinal cross sectional view taken along line II-II in FIG. 8.

The flow channel member 4 constituting the liquid discharge head 2 is described below. FIG. 7 is a plan view showing the flow channel member 4 and the piezoelectric actuator substrate 21 of the head body 13. FIG. 8 is an enlarged plan view of a region surrounded by a chain line in FIG. 7, and shows a part of the head body 13. FIG. 9 is an enlarged perspective view at the same position as that of FIG. 8, from which some of the flow channels are omitted to make the positions of the discharge holes 8 more understandable. In FIGS. 8 and 9, for the purpose of further clarification of the drawing, the pressurizing chambers 10 (pressurizing chamber groups 9), the apertures 12, and the discharge holes 8, which are located below the piezoelectric actuator substrate 21 and therefore should be drawn by a dashed line, are drawn by a solid line. FIG. 10 is a longitudinal cross sectional view taken along line II-II in FIG. 8.

The head body 13 includes the flow channel member 4 having a flat plate shape, and the piezoelectric actuator substrate 21 that is disposed on the flow channel member 4 and includes the pressurizing parts. The piezoelectric actuator substrate 21 has a trapezoidal shape and is disposed on an upper surface of the flow channel member 4 so that a pair of parallel opposite sides of a trapezoid is parallel to one direction of the flow channel member 4.

The flow channel member 4 has thereon four piezoelectric actuator substrates 21, two along each of two virtual straight lines parallel to the one direction of the flow channel member 4. These four piezoelectric actuator substrates 21 are generally arranged in zigzag form on the flow channel member 4. Oblique sides of the piezoelectric actuator substrates 21 adjacent to each other on the flow channel member 4 are partially overlapped with each other in a transverse direction of the flow channel member 4.

The manifold 5 is formed in the flow channel member 4. The manifold 5 has an elongated shape extending along the one direction of the flow channel member 4, and the opening 5*b* of the manifold 5 is formed on an upper surface of the flow channel member 4. There are ten openings 5*b*, five along each of two straight lines (virtual lines) parallel to the one direction of the flow channel member 4. These openings 5*b* are disposed at positions other than a region in which the four piezoelectric actuator substrates 21 are disposed. The liquid is to be supplied from an unshown liquid tank to the manifold 5 through the opening 5*b*.

The manifold 5 formed in the flow channel member 4 is branched into a plurality of pieces. The manifold 5 located at branched portions is generally referred to as a sub manifold 5*a*, and the manifold 5 extending from the opening 5*b* to the sub manifold 5*a* is generally referred to as a liquid supply channel 5*c*. The liquid supply channel 5*c* connected to the opening 5*b* extends along the oblique side of the piezoelectric actuator substrate 21 and is disposed so as to intersect the one direction of the flow channel member 4. In a region lying between the two piezoelectric actuator substrates 21, the single manifold 5 is shared by the piezoelectric actuator substrates 21 adjacent to each other, and the sub manifolds 5*a* are branched on both sides of the manifold 5. These sub manifolds 5*a* are adjacent to each other in regions of the interior of the flow channel member 4 which are respectively opposed to the piezoelectric actuator substrates 21, and extend in one direction of the head body 13. That is, both ends of the sub manifold 5*a* are connected to the liquid supply channel 5*c*.

The flow channel member 4 includes four pressurizing chamber groups 9, each having a plurality of pressurizing chambers 10 disposed in matrix form (namely, two-dimensionally and regularly). The pressurizing chambers 10 are hollow regions having an approximately rhombus planar shape whose corners are rounded. The pressurizing chambers 10 are formed so as to open into the upper surface of the flow channel member 4. These pressurizing chambers 10 are arranged approximately over the entire surface of a region of the upper surface of the flow channel member 4 which is opposed to the piezoelectric actuator substrates 21. Therefore, the pressurizing chamber groups 9 each being formed by these pressurizing chambers 10 occupy a region having approximately the same size and shape as the piezoelectric actuator substrates 21. Openings of the pressurizing chambers 10 are closed by adhesion of the piezoelectric actuator substrates 21 to the upper surface of the flow channel member 4.

In the present embodiment, as shown in FIG. 9, the manifold 5 is branched into four columns E1 to E4 of the sub manifolds 5*a* arranged parallel to one another in the transverse direction of the flow channel member 4. The pressurizing chambers 10 respectively connected to the sub manifolds 5*a* constitute a column of the pressurizing chambers 10 equally spaced in the one direction of the flow channel member 4, and four columns thereof are arranged parallel to one another in the transverse direction. These four columns in which the pressurizing chambers 10 connected to the sub manifolds 5*a* are arranged two on each side of the sub manifold 5*a*.

In entirety, the pressurizing chambers 10 respectively connected from the manifold 5 constitute columns of the pressurizing chambers 10 equally spaced in the one direction of the flow channel member 4, and 16 columns thereof are arranged parallel to one another in the transverse direction. The number of the pressurizing chambers 10 included in each of the pressurizing chamber columns corresponds to an outer shape of the displacement element 50 as the pressurizing part, and an arrangement is made so that the number thereof is gradually decreased from a long side of the outer shape to a short side thereof. The discharge holes 8 are arranged similarly. This ensures an image formation at a resolution of 600 dpi in one direction as a whole.

That is, when the discharge holes 8 are projected so as to be orthogonal to a virtual straight line parallel to the one direction of the flow channel member 4, four discharge holes 8 connected to each of the sub manifold 5*a*, namely, 16 discharge holes 8 in total are equally spaced of 600 dpi in a range R of a virtual straight line shown in FIG. 9. Individual flow channels 32 are connected at spaced intervals corresponding to 150 dpi on an average are connected to each of the sub manifolds 5*a*. The reason for this is as follows. When a setting is made so that the discharge holes 8 corresponding to 600 dpi are dividingly connected to the sub manifolds 5*a* of the four columns, the individual flow channels 32 respectively connected to the sub manifolds 5*a* are not necessarily connected to one another at equally spaced intervals. Therefore, the individual flow channels 32 are formed at spaced intervals of not more than 170 μm on an average (spaced intervals of 25.4 mm/150=169 μm for 150 dpi) in an extending direction of the manifolds 5*a*, namely, a main scanning direction.

Individual electrodes 35 described later are respectively formed at positions opposed to the pressurizing chambers 10 on an upper surface of the piezoelectric actuator substrate 21. Each of the individual electrodes 35 is slightly smaller than the pressurizing chamber 10 and has a shape approximately similar to that of the pressurizing chamber 10. The individual electrodes 35 are disposed so as to fall within a region of the upper surface of the piezoelectric actuator substrate 21 which is opposed to the pressurizing chambers 10.

A large number of discharge holes 8 are formed on the liquid discharge surface 4*a* of a lower surface of the flow channel member 4. These discharge holes 8 are disposed at positions other than a region opposed to the sub manifolds 5*a* disposed on the lower surface of the flow channel member 4.

These discharge holes 8 are disposed in a region of the lower surface of the flow channel member 4 which is opposed to the piezoelectric actuator substrate 21. These discharge holes 8 as a group occupy a region having approximately the same size and shape as the piezoelectric actuator substrate 21. Liquid drops are dischargeable by displacing the displacement elements 50 of the corresponding piezoelectric actuator substrate 21. The discharge holes 8 are arranged at equally spaced intervals along a plurality of straight lines parallel to the one direction of the flow channel member 4.

The flow channel member 4 included in the head body 13 has a laminate structure having a plurality of plates laminated one upon another. These plates are a cavity plate 22, a base plate 23, an aperture plate 24, supply plates 25 and 26, manifold plates 27, 28, and 29, a cover plate 30, and a nozzle plate 31 in descending order from the upper surface of the flow channel member 4. A large number of holes are formed in these plates. These plates are positioned and laminated so that these holes are communicated with one another to constitute the individual flow channels 32 and the sub manifolds 5*a*.

In the head body 13, as shown in FIG. 10, the pressurizing chambers 10 are disposed on the upper surface of the flow channel member 4, the sub manifolds 5*a* are disposed on the lower surface in the interior of the flow channel member 4, and the discharge holes 8 are disposed on the lower surface of the flow channel member 4. Thus, parts constituting the individual flow channels 32 are disposed close to one another at different positions so as to ensure that the sub manifolds 5*a* and the discharge holes 8 are connected to one another via the pressurizing chamber 10.

The holes formed in the foregoing plates are described below. These holes can be classified into the following ones. Firstly, there is the pressurizing chamber 10 formed in the cavity plate 22. Secondly, there is a communication hole constituting the flow channel extending from one end of the pressurizing chamber 10 to the sub manifold 5*a*. This communication hole is formed in each of the plates, from the base plate 23 (specifically, an inlet of the pressurizing chamber 10) to the supply plate 25 (specifically, an outlet of the sub manifold 5*a*). This communication hole includes the aperture 12 that is formed on the aperture plate 24, and the individual supply flow channel 6 formed on the supply plates 25 and 26.

Thirdly, there is a communication hole constituting the flow channel that establishes communication from the other end of the pressurizing chamber 10 to the discharge hole 8. This communication hole is hereinafter referred to as a descender (partial flow channel). The descender is formed in each of the plates, from the base plate 23 (specifically, an outlet of the pressurizing chamber 10) to the nozzle plate 31 (specifically, the discharge hole 8).

Fourthly, there is a communication hole constituting the sub manifold 5. This communication hole is formed in the manifold plates 27 to 29.

These communication holes are connected to one another to form the individual flow channel 32 that extends from the inlet for liquid from the sub manifold 5*a* (the outlet of the sub manifold 5*a*) to the liquid discharge hole 8. The liquid supplied to the sub manifold 5*a* is discharged from the liquid discharge hole 8 through the following route. Firstly, the liquid proceeds upward from the sub manifold 5*a*, passes through the individual supply flow channel 6 and reaches one end of the aperture 12. The liquid then proceeds horizontally along an extending direction of the aperture 12 and reaches the other end of the aperture 12. Subsequently, the liquid proceeds upward from there and reaches one end of the pressurizing chamber 10. Further, the liquid proceeds horizontally along an extending direction of the pressurizing chamber 10 and reaches the other end of the pressurizing chamber 10. The liquid then mainly proceeds downward while gradually moving from the other end of the pressurizing chamber 10 in a horizontal direction, and proceeds to the liquid discharge hole 8 being opened into the lower surface.

The piezoelectric actuator substrate 21 has a laminate structure formed of two piezoelectric ceramic layers 21*a* and 21*b* as shown in FIG. 10. Each of these piezoelectric ceramic layers 21*a* and 21*b* has a thickness of approximately 20 μm. An overall thickness of the piezoelectric actuator unit 21 is approximately 40 μm. Both the piezoelectric ceramic layers 21*a* and 21*b* are extended across a plurality of liquid pressurizing chambers 10 (refer to FIG. 8). These piezoelectric ceramic layers 21*a* and 21*b* are formed of a ferroelectric lead zirconate titanate (PZT) based ceramic material.

The piezoelectric actuator substrate 21 includes a common electrode 34 formed of an Ag—Pd based metal material or the like, and the individual electrode 35 formed of an Au based metal material or the like. As described above, the individual electrode 35 is disposed at the position opposed to the pressurizing chamber 10 on the upper surface of the piezoelectric actuator substrate 21. One end of the individual electrode 35 is led out beyond the region opposed to the pressurizing chamber 10 so as to form a connection electrode 36. The connection electrode 36 is formed of, for example, silver-palladium containing glass frit, and is protrudedly formed with a thickness of approximately 15 μm. The connection electrode 36 is electrically connected to an electrode disposed on the flexible wiring board 92. Although the details thereof are described later, a driving signal is supplied from the control section 100 to the individual electrode 35 via the flexible wiring board 92. The driving signal is supplied on a fixed cycle in synchronization with a transport speed of a printing medium P.

The common electrode 34 is formed approximately over the entire surface in a planar direction in a region between the piezoelectric ceramic layer 21*a* and the piezoelectric ceramic layer 21*b*. That is, the common electrode 34 extends to cover all the pressurizing chambers 10 in a region opposed to the piezoelectric actuator substrate 21. The common electrode 34 has a thickness of approximately 2 μm. The common electrode 34 is grounded and held at ground potential in an unshown region. In the present embodiment, a surface electrode (not shown) different from the individual electrodes 35 is formed at a position that is kept away from an electrode group formed of the individual electrodes 35 on the piezoelectric ceramic layer 21*b*. The surface electrode is electrically connected to the common electrode 34 via a through hole formed in the piezoelectric ceramic layer 21*b*. Similarly to the large number of individual electrodes 35, the surface electrode is connected to another electrode on the flexible wiring board 92.

As shown in FIG. 10, the common electrode 34 and the individual electrode 35 are disposed so as to hold therebetween only the piezoelectric ceramic layer 21*b* that is the uppermost layer. A region in the piezoelectric ceramic layer 21*b* which is held between the individual electrode 35 and the common electrode 34 is referred to as an active area, and the piezoelectric ceramics corresponding to the active area is polarized. In the piezoelectric actuator substrate 21 of the present embodiment, only the uppermost piezoelectric ceramic layer 21*b* includes the active area, and the piezoelectric ceramic 21*a* does not include the active area and acts as a vibrating plate. The piezoelectric actuator substrate 21 has a so-called unimolf type configuration.

As described later, a predetermined driving signal is selectively applied to the individual electrode 35, thereby applying a pressure to the liquid in the pressurizing chamber 10 corresponding to the individual electrode 35. Consequently, liquid drops are discharged from the corresponding liquid discharge hole 8 through the individual flow channel 32. That is, a portion of the piezoelectric actuator substrate 21 which is opposed to the pressurizing chamber 10 corresponds to the individual displacement element 50 (actuator) corresponding to the pressurizing chamber 10 and the liquid discharge hole 8. Specifically, the displacement element 50, whose unit structure is the structure as shown in FIG. 10, is fabricated into a laminate body formed of two piezoelectric ceramic layers in each of the pressurizing chambers 10 by using a vibrating plate 21*a*, the common electrode 34, the piezoelectric ceramic layer 21*b*, and the individual electrode 35, each of which is located immediately above the pressurizing chamber 10. The piezoelectric actuator substrate 21 includes the displacement elements 50 that are the pressurizing parts. In the present embodiment, the amount of the liquid discharged from the liquid discharge hole 8 by a single discharge operation is approximately 5 to 7 pL (pico litter).

The large number of individual electrodes 35 are individually electrically connected to the control section 100 via the flexible wiring boards 92 and wiring so as to ensure individual control of potential.

When the individual electrode 35 is set at a different potential from that of the common electrode 34 and an electric field is applied to the piezoelectric ceramic layer 21*b* in a polarization direction thereof on the piezoelectric actuator substrate 21 of the present embodiment, a portion to which the electric field is applied acts as the active area that is distorted by piezoelectric effect. On this occasion, the piezoelectric ceramic layer 21*b* expands or contracts in a thickness direction, namely, lamination direction thereof, and attempts to contract or expand in a direction perpendicular to the lamination direction, namely, the planar direction by transverse piezoelectric effect. On the other hand, the rest of the piezoelectric ceramic layer 21*a* is a non-active layer that does not include the region held between the individual electrode 35 and the common electrode 34, and therefore does not deform spontaneously. That is, the piezoelectric actuator substrate 21 has a so-called unimolf type configuration in which the piezoelectric ceramic layer 21*b* on an upper side (namely, a side away from the pressurizing chamber 10) is the layer including the active area, and the piezoelectric ceramic layer 21*a* on a lower side (namely, a side close to the pressurizing chamber 10) is the non-active layer.

When, in this configuration, the individual electrode 35 is set at a positive or negative predetermined potential with respect to the common electrode 34 by the control section 100 so that the electric field and the polarization are oriented in the same direction, a portion (active area) held between the electrodes of the piezoelectric ceramic layer 21*b* contracts in the planar direction. On the other hand, the piezoelectric ceramic layer 21*a* as the non-active layer is not affected by the electric field, and therefore does not contract spontaneously but attempts to restrict deformation of the active area. Consequently, a difference of distortion in the polarization direction occurs between the piezoelectric ceramic layer 21*b* and the piezoelectric ceramic layer 21*a*, and the piezoelectric ceramic layer 21*b* is deformed so as to protrude toward the pressurizing chamber 10 (unimolf deformation).

According to an actual driving procedure in the present embodiment, the individual electrode 35 is previously set at a first voltage V1 (V) (hereinafter "volt" is generally omitted) that allows the individual electrode 35 to have a higher potential than the common electrode 34. Then, the individual electrode 35 and the common electrode 34 are temporarily set at a lower potential, for example, the same potential by applying a second voltage lower than the first voltage V1 every time a discharge request is made, and thereafter are set again at a high potential at predetermined timing. This allows the piezoelectric ceramic layers 21*a* and 21*b* to return to their original shape at timing that the individual electrode 35 has a low potential, and the volume of the pressurizing chamber 10 is increased compared to its initial state (a state in which both electrodes have different potentials). On this occasion, a negative pressure is applied into the pressurizing chamber 10 and the liquid is absorbed from the manifold 5 into the pressurizing chamber 10.

Thereafter, at the timing that the individual electrode 35 is set again at the high potential, the piezoelectric ceramic layers 21*a* and 21*b* are deformed so as to protrude toward the pressurizing chamber 10. Due to a reduced volume of the pressurizing chamber 10, the pressure in the pressurizing chamber 10 becomes a positive pressure and the pressure applied to the liquid is increased to discharge liquid drops. That is, the driving signal containing pulses using the high potential as a standard is supplied to the individual electrode 35 for the purpose of discharging the liquid drops. An ideal pulse width is an AL (acoustic length) that is a length of time during which a pressure wave propagates from the manifold 5 to the liquid discharge hole 8 in the pressurizing chamber 10. Thereby, when a negative pressure state is reversed to a positive pressure state in the pressurizing chamber 10, both pressures are combined together to allow the liquid drops to be discharged under a stronger pressure.

In a gradation printing, a gradation expression is made by the number of liquid drops to be continuously discharged from the discharge hole 8, namely, the amount of liquid drops (volume) to be adjusted by the number of discharges of liquid drops. Therefore, the discharges of liquid drops, the number of which corresponds to a designated gradation expression, are continuously performed from the discharge hole 8 corresponding to a designated dot region. In general, when the liquid discharge is performed continuously, an interval between one pulse and another to be supplied for discharging the liquid drops is preferably set to the AL. This ensures that a cycle of a residual pressure wave of a pressure generated when discharging an early discharged liquid drop coincides with a cycle of a pressure wave of a pressure generated when discharging a later discharged liquid drop, and both are superimposed to amplify the pressure for discharging the liquid drops. In this case, the speed of the later discharged liquid drop seems to increase, however, this is preferred because landing points of a plurality of liquid drops become closer to each other.

Second Embodiment

Figure 11:
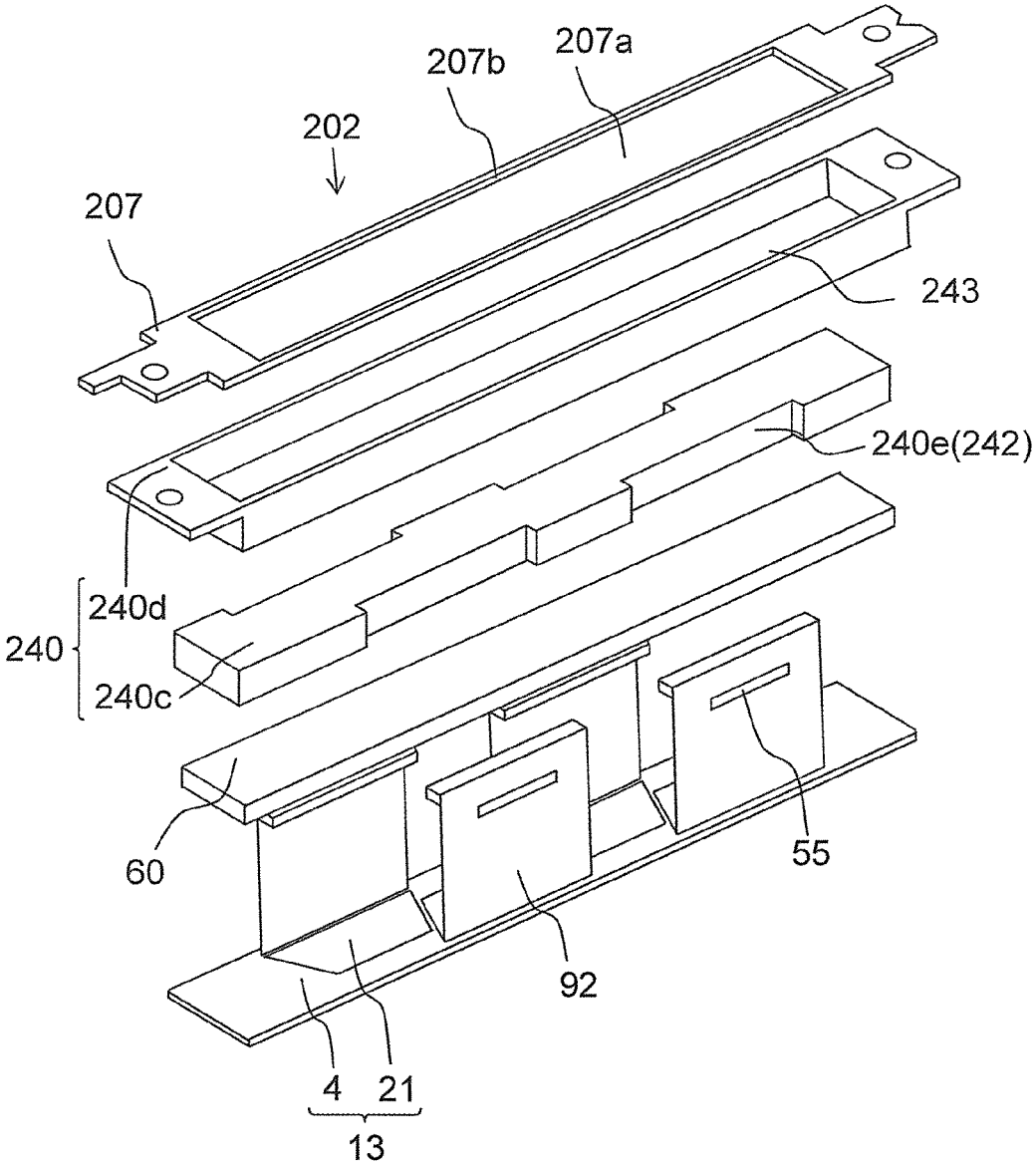
FIG. 11 is an exploded perspective view of a liquid discharge head according to a second embodiment.

A liquid discharge head 202 according to a second embodiment is described below with reference to FIGS. 11 and 12. Like parts bear the same reference characters, and the same applies to the following.

In the liquid discharge head 202, a reservoir flow channel member 240 is formed of a first reservoir flow channel member 240*c* and a second reservoir flow channel member 240*d* surrounding the first reservoir flow channel member 240*c*. The first reservoir flow channel member 240*c* forms the reservoir flow channel member 240 by being fitted into the second reservoir flow channel member 240*d*. The first reservoir flow channel member 240*c* is an embodiment related to a first cover member of the present invention. The first cover member is described below by illustrating the reservoir flow channel member 240*c*. The second reservoir flow channel member 240*d* is an embodiment related to a second cover member of the present invention. The second cover member is described below by illustrating the reservoir flow channel member 240*d*.

The first reservoir flow channel member 240*c* has a reservoir flow channel (not shown) therein, and four recesses 240*e* on a side surface thereof. The second reservoir flow channel member 240*d* has an opening 243 at a central part thereof, and the first reservoir flow channel member 240*c* is disposed in the opening 243. Therefore, a portion formed by the opening 243 of the second reservoir flow channel member 240*d* and the recess 240 of the first reservoir flow channel member 240*c* constitutes a hole 242 of the reservoir flow channel member 240.

Thus in the liquid discharge head 202, the reservoir flow channel member 240 is formed by the first reservoir flow channel member 240*c* and the second reservoir flow channel member 240*d*, and the hole 242 is formed by the first reservoir flow channel member 240*c* and the second reservoir flow channel member 240*d*.

The branch flow channel member 60 and the first reservoir flow channel member 240*c* are disposed on the head body 13. The flexible wiring board 92 is inserted from the recess 240*e* of the first reservoir flow channel member 240*c*, and the second reservoir flow channel member 240*d* is disposed outside the flexible wiring board 92, thereby allowing the flexible wiring board 92 to be inserted into the hole 242. This ensures easy assembly of the liquid discharge head 240 and also improves producibility of the liquid discharge head 2.

Figure 12:
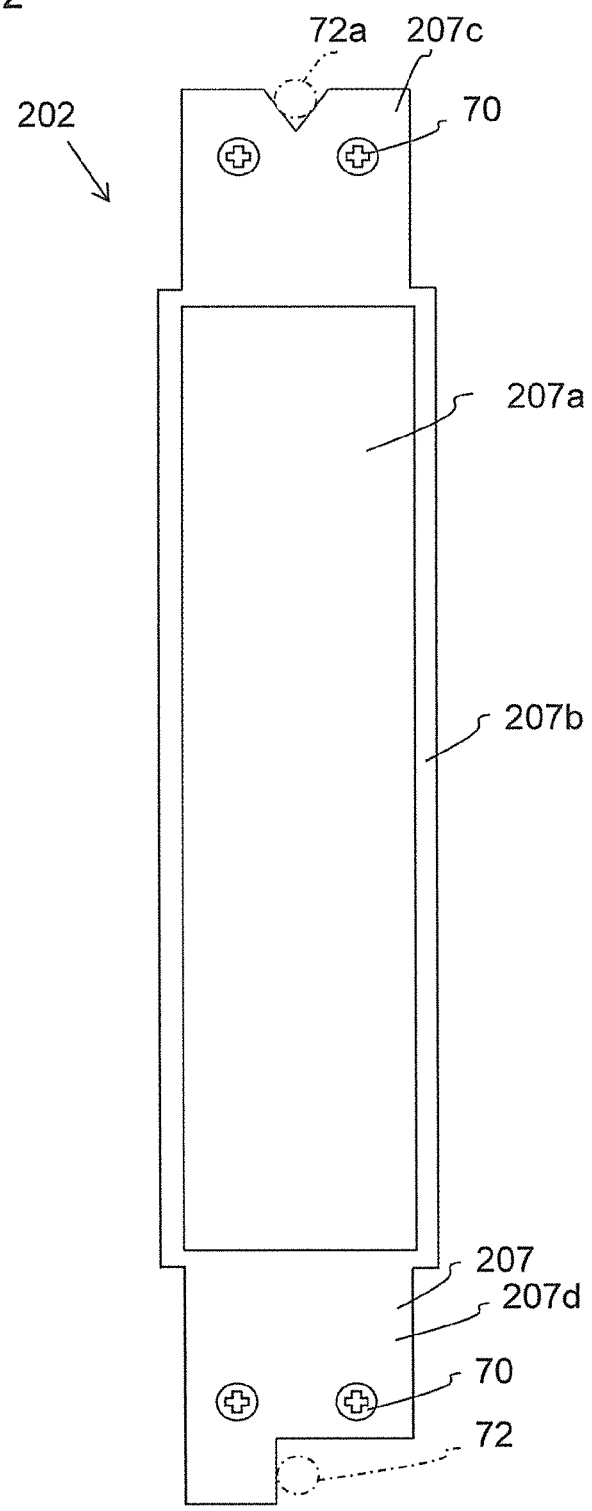
FIG. 12 is a plan view of a second member constituting the liquid discharge head shown in FIG. 11.

As shown in FIG. 12, a positioning member 207 differs from the positioning member 7 in the shape of a positioning portion 207*d*, and other portions are similar to those of the positioning member 7.

In the positioning member 207, a positioning portion 207*c* has an L-shape in a plan view, and the positioning portion 207*d* has a concave portion 207*e* at an end thereof.

A method of positioning the positioning member 207 is described below. Firstly, the concave portion 207*e* of the positioning portion 207*d* and one positioning pin 72*a* are brought into contact with each other. On this occasion, both are brought into contact with each other so as to establish contact between two sides constituting the concave portion 207*e* and the positioning pin 72*a*.

Subsequently, the liquid discharge head 202 is rotated around the positioning pin 72*a* disposed so as to contact with the concave portion 207*e*. Then, the liquid discharge head 202 is mounted on the printer by bringing the positioning pin 72*b* and the positioning portion 207*c* into contact with each other.

Thus, the positioning portion 207*d* has the concave portion 207*e*, and the positioning pin 72*a* is disposed so as to contact with the concave portion 207*e*. This reduces a deviation in one direction of the liquid discharge head 202, and also strengthens connections between the liquid discharge head 202 and the positioning pins 72*a* and 72*b* during positioning.

Two screws 70 are disposed to fix the positioning member 207 and the second reservoir flow channel member 240*d* together, and the positioning pins 72*a* and 72*b* are disposed at positions between the two screws 70, thereby further strengthening the connection between the liquid discharge head 202 and the positioning pins 72*a* and 72*b*.

Third Embodiment

Figure 13A:
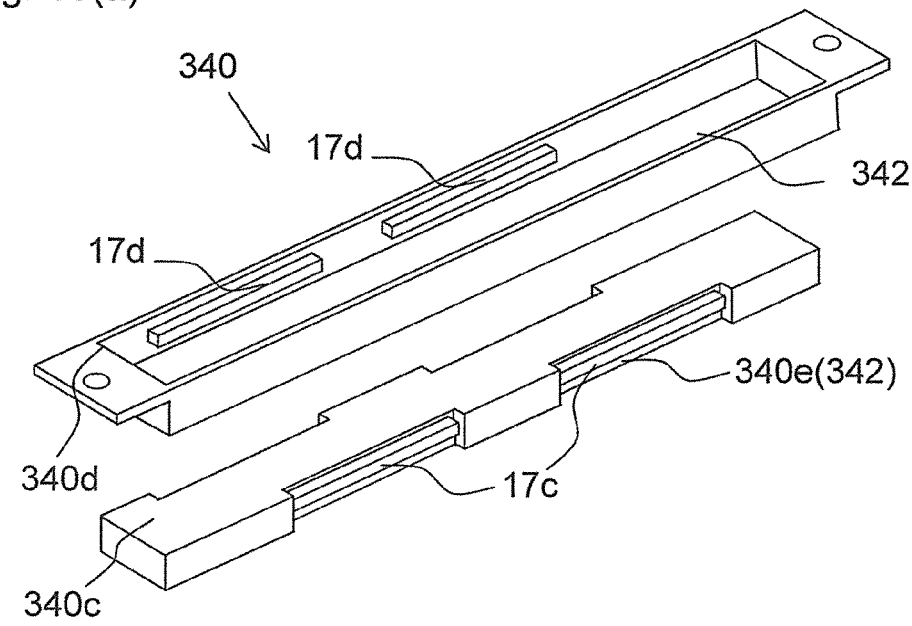
FIG. 13(*a*) is an exploded perspective view of a first member of a liquid discharge head according to a third embodiment, and FIG. 13(*b*) is a cross sectional view thereof.
Figure 13B:
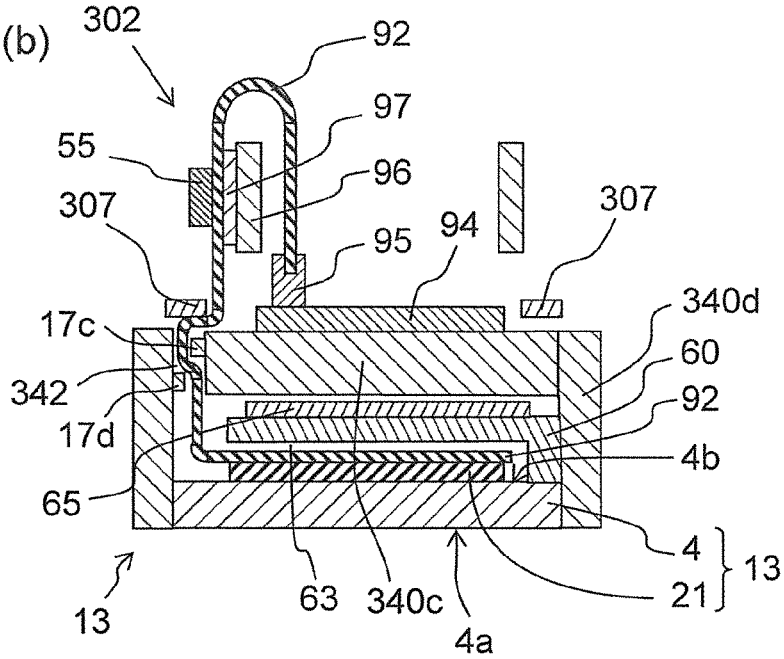

A third embodiment is described with reference to FIG. 13. A liquid discharge head 302 differs from the liquid discharge head 202 (refer to FIG. 11) in the configuration of a reservoir flow channel member 340. FIG. 13(*a*) shows only the reservoir flow channel member 340. The housing 90 (refer to FIG. 4) is omitted in FIG. 13(*b*).

A first reservoir flow channel member 340*c* has four recesses 340*e* on a side surface thereof. A second reservoir flow channel member 340*d* has an opening 343 at a central part thereof. The first reservoir flow channel member 340*c* is disposed in the opening 343. Therefore, a portion formed by the opening 343 of the second reservoir flow channel member 340*d* and the recesses 340*e* of the first reservoir flow channel member 340*c* constitutes a hole 342 of the reservoir flow channel member 340.

The recesses 340*e* of the first reservoir flow channel member 340*c* are respectively provided with first protrusions 17*c* that protrude toward the hole 342. The second reservoir flow channel member 340*d* has second protrusions 17*d* that protrude toward the hole 342.

As shown in FIG. 13(*b*), the first protrusions 17*c* and the second protrusions 17*d* are disposed at different heights. Although being unshown, the first protrusions 17*c* and the second protrusions 17*d* are respectively disposed in all the four holes 342.

Accordingly, each of the flexible wiring boards 92 is to be pressed by the first protrusions 17*c* and the second protrusions 17*d* when being inserted through the hole 342. Consequently, as shown in FIG. 13(*b*), the flexible wiring board 92 becomes bendable and functions to bury the hole 442, thereby reducing the possibility that ink intrudes into the interior of the liquid discharge head 302.

Particularly, even when ink in mist state floats in the vicinity of the holes 342, the ink that has intruded into the holes 442 is to contact with the flexible wiring boards 92 over a wide area at bent portions of the flexible wiring boards 92, thus allowing the ink to attach to the flexible wiring boards 92. It is therefore possible to prevent intrusion of the ink into the interior of the liquid discharge head 302.

The first protrusions 17*c* and the second protrusions 17*d* are preferably disposed so as to close the holes 342 in a plan view. That is, a sum of a width of the first protrusion 17*c* and a width of the second protrusion 17*d* is made longer than a width of the hole 342 in the plan view. This configuration allows the flexible wiring boards 92 to be surely bent, thus reducing the possibility of the intrusion of the ink.

The foregoing illustrates, by way of example, the case where the liquid discharge head 302 includes the first protrusions 17*c* and the second protrusions 17*d*, but examples of the liquid discharge head are not limited to this. For example, the first reservoir flow channel member 320*c* may have only the first protrusions 17*c*. The second reservoir flow channel member 320*d* may have only the second protrusion 17*d*. These configurations also allow the flexible wiring boards 92 to be bent, thus reducing the possibility of the intrusion of the ink.

A plurality of the first protrusions 17*c* and a plurality of the second protrusions 17*d* may be disposed, which are preferably disposed alternately in a cross sectional view. By alternately disposing the first protrusions 17*c* and the second protrusions 17*d* in the cross sectional view, the number of bending of the flexible wiring boards 92 can be increased to further reduce the possibility of the intrusion of the ink.

That is, even when mist-state ink intrudes into the holes 342, the flexible wiring boards 92 are bent a plurality of times, thus making it possible to increase the number of contacts between the mist-state ink and the flexible wiring boards 92 and the holes 342. This reduces the possibility that the ink intrudes into the interior of the liquid discharge head 302.

Even when the ink attaches to the flexible wiring boards 92 and the attached ink flows downward, the positioning member 307, the first protrusions 17*c* and the second protrusions 17*d* are capable of damming up the flow of the ink flowing downward, thereby reducing the possibility that the ink intrudes into the interior of the liquid discharge head 302.

Although the foregoing illustrates the configuration that the first protrusions 17*c* and the second protrusions 17*d* extend along one direction of the liquid discharge head 302, a similar effect is attainable in the case of intermittently disposing the first protrusions 17*c* and the second protrusions 17*d*.

Although the foregoing illustrates the case where the first protrusions 17*c* are disposed on the first reservoir flow channel 342*c* and the second protrusions 17*d* are disposed on the second reservoir flow channel 342*d*, only either of them may be disposed.

Fourth Embodiment

A fourth embodiment is described with reference to FIG. 14. The fourth embodiment differs from the foregoing embodiments in the configurations of a positioning member 407 and a reservoir flow channel member 440.

Figure 14A:
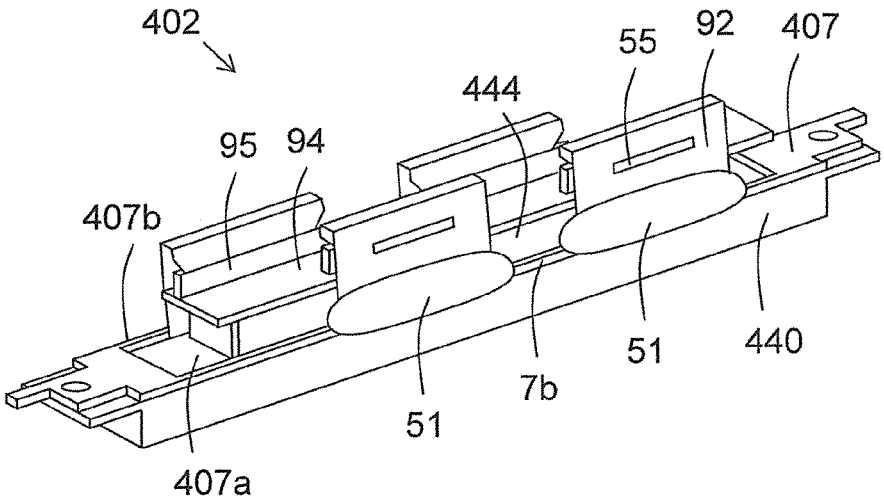
FIG. 14(*a*) is a perspective view of a liquid discharge head according to a fourth embodiment, and FIG. 14(*b*) is a cross sectional view thereof.
Figure 14B:
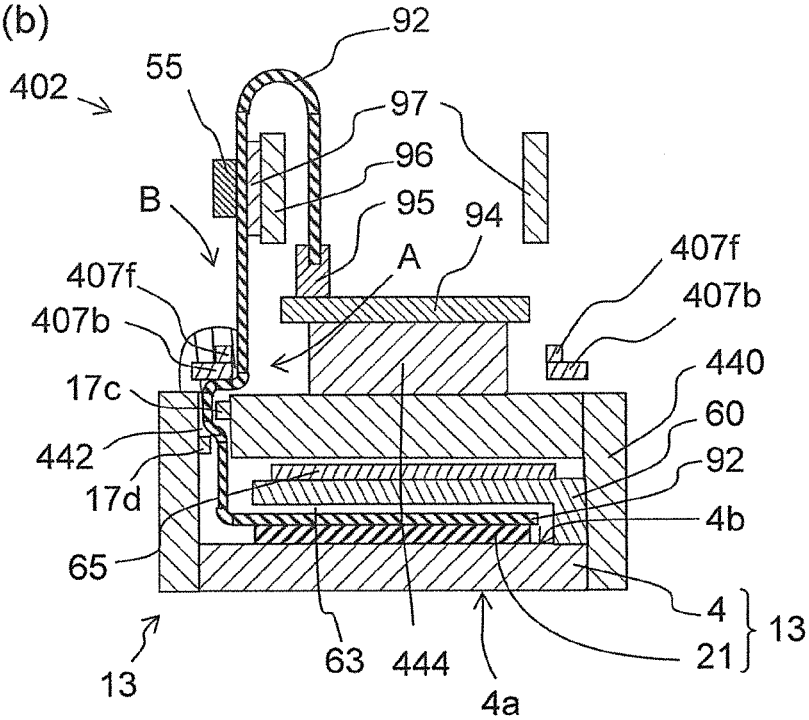

As shown in FIG. 14(*b*), the positioning member 407 has a flange 407*f* disposed on a coupling portion 407*b*. The flange 407*f* is disposed on a portion of the coupling portion 407*b* which is close to an opening 407*a*. This ensures that the flexible wiring boards 92 are held between a frame 96 and the flange 407*f*. Consequently, even when ink attaches to the flexible wiring boards 92 and the attached ink flows downward, the flange 407*f* is capable of suppressing the intrusion of the ink.

Owing to the flange 407*f* provided on the positioning member 407, contacts between the flexible wiring boards 92 and the positioning member 407 contribute to reducing the possibility that the flexible wiring board 92 are subjected to wear.

The positioning member 407 has the flange 407*f* on the coupling portion 407*b*, thus making it possible to enhance the rigidity of the coupling portion 407*b*. Consequently, the positioning portions 407*c* and 407*d* are unsusceptible to deformation, thus leading to improved positioning accuracy.

The reservoir flow channel member 440 has a protrusion 444 on an upper surface thereof. The protrusion 444 is disposed in the interior of an opening 7*a* of the positioning member 7. A substrate 94 is disposed on an upper surface of the protrusion 444. Covering members 51 are respectively disposed so as to cover holes 442 of the reservoir flow channel member 440.

In addition to covering the holes 442 with the flexible wiring boards 92 and the positioning member 7, the holes 442 are respectively further covered with the covering members 51, thereby further improving sealability.

In a liquid discharge head 402, each of the covering members 51 is disposed so as to seal a clearance between the hole 442 of the reservoir flow channel member 440 and the flexible wiring board 92. More specifically, the covering members 51 are disposed so as to cover the coupling portion 407*b* of the positioning member 407.

Owing to the coupling portion 407*b* of the positioning member 407 disposed above the holes 442 of the reservoir flow channel member 440, the holes 442 are to be led out upward after the flexible wiring boards 92 are pressed and bent. Therefore, when mist-state ink intrudes from an arrowed direction A shown in FIG. 14(*b*), the intrusion of the ink is preventable by the bent flexible wiring boards 92.

Owing to the covering members 51 disposed so as to cover the coupling portion 407*b* from the outside of the opening 407*a*, when the mist-state ink intrudes from an arrowed direction B shown in FIG. 14(*b*), the intrusion of the ink is preventable by the covering members 51.

That is, with such a configuration that the flexible wiring boards 92 are inserted from the inside of the opening 407*a* and the covering members 51 are disposed so as to cover the coupling portion 407*b* from the outside of the opening 407*a*, it is possible to reduce the possibility that the mist-state ink intrudes up to the head body 13.

The covering members 51 are capable of strengthening connection between the coupling portion 7*b* of the positioning member 7 and a first member 16.

With the configuration that the covering members 51 are disposed so as to cover the coupling portion 407*b* from the outside of the opening 407*a*, the covering members 51 can be coated after the flexible wiring boards 92 are pressed by the positioning member 407, thereby improving the sealability of the holes 442. Additionally, it is easy to coat the covering members 51, thereby improving working efficiency in manufacturing processes of the inkjet head 2.

Examples of the covering members 51 include thermosetting resin, silicone, and UV-curable resin. The covering members 51 are preferably formed by a heat releasing member using a heat releasing resin or a resin incorporating heat releasing particles, such as metal particles.

By forming the covering members 51 using the heat releasing member, when heat of the driver ICs 55 generated during driving is subjected to heat conduction via internal wiring (not shown) of the flexible wiring boards 92, the heat is subjected to heat conduction to the covering members 51 so as to be released to other member. More effective heat release is attainable when the positioning member 407 is formed of a metal or alloy having high thermal conductivity.

In the present embodiment, a displacement element 50 using piezoelectric deformation is illustrated as the pressurizing part, without being limited thereto. It is possible to employ another one that can pressurize liquid in the pressurizing chambers 10. There are, for example, one that generates pressure by heating and boiling the liquid in the pressurizing chambers 10, and one that uses MEMS (micro electro mechanical systems).

Although the case of using the reservoir flow channel member 40 as the first member has been described above, a cover member having no flow channel therein may be used instead of the reservoir flow channel member 40. For example, the liquid discharge head 2 may be configured to supply the liquid from the exterior to the liquid inlet hole 5*b* of the manifold 5 through a tube or the like. In this case, the first member needs to have the function of protecting the piezoelectric actuator substrate 21. Also in this case, the holes 42 can be covered with the positioning member 7 and the flexible wiring boards 92, thus leading to equivalent effect.

Although the foregoing illustrates the case of using the positioning member 7 as the second member, for example, a lid member for covering the holes 42 may be employed instead of the positioning member 7. Alternatively, the positioning member 7 may be one in which the positioning portions 7*c* and 7*d* are not connected to each other by the coupling portion 7*b*. For example, the positioning member 7 may be one in which the positioning portions 7*c* and 7*d* are formed separately.

The present embodiment illustrates, by way of example, the case where the flexible wiring boards 92 and the positioning member 7 are in contact with each other. The positioning member 7 needs to be located above the holes 42, and the flexible wiring boards 92 and the positioning member 7 may not be in contact with each other. Also in this case, the positioning member 7 located above the holes 42 is capable of reducing the possibility that the mist-state ink intrudes from above into the holes 42, thereby reducing the possibility of the intrusion of the ink into the interior of the liquid discharge head 2.

A clearance may exist between the reservoir flow channel member 40 and the flexible wiring boards 92 and between the positioning member 7 and the flexible wiring boards 92. Also in this case, because most of the mist-state ink can intrude from above the holes 42, the positioning member 7 located above the holes 42 is capable of reducing the possibility that the mist-state ink intrudes from above into the holes 42, thereby reducing the possibility of the intrusion of the ink into the interior of the liquid discharge head 2.

DESCRIPTION OF REFERENCE NUMERALS

1 printer
2 liquid discharge head
4 flow channel member
4*a* discharge hole surface
4*b* pressurizing chamber surface
5 manifold (common flow channel)
5*a* sub manifold
5*b* opening of manifold (liquid inlet hole)
5*c* liquid supply passage
6 individual supply flow channel
7 positioning member
7*a* opening
7*b* coupling portion
7*c* positioning portion
7*d* positioning portion
8 discharge hole
9 pressurizing chamber group
10 pressurizing chamber
12 aperture
15*a*, 15*b*, 15*c*, 15*d* discharge hole column
17 protrusion
17*c* first protrusion
17*d* second protrusion
21 piezoelectric actuator substrate
22-31 plate
32 individual flow channel
34 common electrode
35 individual electrode
36 connection electrode
40 reservoir flow channel member
40*a* reservoir flow channel member body
40*b* plate
40*c* first reservoir flow channel member
40*d* second reservoir flow channel member
41 reservoir flow channel
42 hole
43 side surface protection plate
45 filter
47 damper
50 displacement element (pressurizing part)
51 covering member
60 branch flow channel member
60*a*-60*c* plate
61 branch flow channel
90 housing
90*c* hole
92 flexible wiring board
94 substrate
95 connector
96 frame
97 heat insulation elastic member

The invention claimed is:

1. A liquid discharge head, comprising:

a head body comprising a discharge hole, a pressurizing chamber communicating with the discharge hole, and a pressurizing part disposed correspondingly to the pressurizing chamber;

a flexible wiring board electrically connected to the pressurizing part and including a first surface and a second surface opposite the first surface;

a first member supported by the head body and having a hole, the first member in contact with the first surface; and a second member in contact with the second surface, wherein the flexible wiring board is passed through the hole and is led out from between the first member and the second member.

2. The liquid discharge head according to claim 1, wherein the second member covers the hole in a plan view.

3. The liquid discharge head according to claim 2, wherein the flexible wiring board is held by the first member and the second member.

4. The liquid discharge head according to claim 2, wherein the second member presses the flexible wiring board.

5. The liquid discharge head according to claim 1, wherein the first member and the second member are connected to each other by a connection member.

6. The liquid discharge head according to claim 1, wherein the head body is elongated in one direction;

wherein the second member comprises positioning portions respectively disposed on both ends in one direction, and a coupling portion that connects the positioning portions together, and wherein the coupling portion covers the hole.

7. The liquid discharge head according to claim 6, wherein the second member comprises an opening formed by the positioning portions and the coupling portion, and wherein the flexible wiring board is led out upward through the opening of the second member.

8. The liquid discharge head according to claim 1, wherein the first member comprises a first cover member and a second cover member, and wherein the hole is formed by a gap between the first cover member and the second cover member.

9. The liquid discharge head according to claim 8, wherein the first cover member comprises a first protrusion that protrudes toward the second cover member.

10. The liquid discharge head according to claim 8, wherein the second cover member comprises a second protrusion that protrudes toward the first cover member.

11. The liquid discharge head according to claim 8, wherein the first cover member comprises a first protrusion that protrudes toward the second cover member, wherein the second cover member comprises a second protrusion that protrudes toward the first cover member, and wherein the first protrusion and the second protrusion are disposed at different heights.

12. The liquid discharge head according to claim 1, further comprising a covering member that seals a clearance between the hole and the flexible wiring board.

13. A recording device, comprising:

a liquid discharge head according to claim 1;

a transport section configured to transport a recording medium with respect to the liquid discharge head; and a control section configured to control the liquid discharge head.

14. The liquid discharge head according to claim 8, wherein the first cover member is positioned between opposing portions of the second cover member.

15. The liquid discharge head according to claim 1, wherein the flexible wiring board includes at least a first portion, a second portion, and a third portion, the first portion and the third portion being generally parallel and connected to each other by the second portion, and wherein the first member is in contact with the first portion of the flexible wiring board and the second member is in contact with the second portion of the flexible wiring board.

16. The liquid discharge head according to claim 15, wherein the first portion of the flexible wiring board is in the hole and the second portion of the flexible wiring board is a bent portion that extends out of the hole.

17. A liquid discharge head, comprising:

a head body comprising a discharge hole, a pressurizing chamber communicating with the discharge hole, and a pressurizing part disposed correspondingly to the pressurizing chamber;

a flexible wiring board electrically connected to the pressurizing part and including a first surface, a second surface opposite the first surface, a first end electrically connected to the pressurizing part, and a second end electrically connected to a connector;

a first member having a hole, the first member in contact with the first surface; and a second member contacting the second surface of the flexible wiring board and positioning the connector, wherein the flexible wiring board is passed through the hole and is led out from between the first member and the second member.

18. The liquid discharge head according to claim 17, wherein the first surface is in contact with an edge of the hole of the first member.

19. A liquid discharge head, comprising:

a flow channel member having a liquid discharge surface;

a piezoelectric actuator disposed on an opposite surface of the liquid discharge surface of the flow channel member;

a chambering member with a hole chambering the piezoelectric actuator therein;

a flexible wiring board connected to the piezoelectric actuator and led out of the chambering member through the hole; and a covering member disposed on the chambering member and covering the hole; and wherein the flexible wiring board comprises a first surface and a second surface opposite the first surface, the first surface being in contact with the chambering member and the second surface being in contact with the covering member.

20. The liquid discharge head according to claim 19, wherein the first surface is in contact with an edge of the hole of the chambering member.

* * * * *